US011389983B2

(12) United States Patent
Sugiyama

(10) Patent No.: US 11,389,983 B2
(45) Date of Patent: Jul. 19, 2022

(54) CUTTING APPARATUS

(71) Applicant: BROTHER KOGYO KABUSHIKI KAISHA, Nagoya (JP)

(72) Inventor: Kentaro Sugiyama, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/171,727

(22) Filed: Feb. 9, 2021

(65) Prior Publication Data

US 2021/0162618 A1 Jun. 3, 2021

Related U.S. Application Data

(63) Continuation of application No. PCT/JP2019/012758, filed on Mar. 26, 2019.

(30) Foreign Application Priority Data

Aug. 10, 2019 (JP) ..... 2018-151999

(51) Int. Cl.
*B26D 5/12* (2006.01)
*B26D 7/26* (2006.01)
*B26D 7/28* (2006.01)

(52) U.S. Cl.
CPC ..... *B26D 5/12* (2013.01); *B26D 7/2628* (2013.01); *B26D 7/28* (2013.01)

(58) Field of Classification Search
CPC . B26D 5/083; B26D 5/24; B26D 5/00; B26D 5/005; B26D 5/38; B26D 5/08;
(Continued)

(56) References Cited

U.S. PATENT DOCUMENTS

2005/0186010 A1* 8/2005 Shibata ..... B26D 7/015 400/621
2012/0247293 A1 10/2012 Nagai et al.
(Continued)

FOREIGN PATENT DOCUMENTS

JP H02-116497 A 5/1990
JP H02-262995 A 10/1990
(Continued)

OTHER PUBLICATIONS

International Preliminary Report on Patentability dated Feb. 16, 2021 in connection with PCT/JP2019/012758.
(Continued)

*Primary Examiner* — Nhat Chieu Q Do
(74) *Attorney, Agent, or Firm* — K&L Gates LLP

(57) ABSTRACT

A controller of a cutting apparatus obtains cutting data and specifies a pressure value corresponding to pressure to be applied to an attaching portion by a pressure changer during cutting processing for cutting a workpiece using a cutting blade based on the cutting data and a target range defining target positions of the attaching portion in a fifth direction. While causing the pressure changer to apply, to the attaching portion, the pressure corresponding to the specified pressure value, the controller executes the cutting processing by controlling a first moving mechanism and obtains the position of the attaching portion in the fifth direction. If the obtained position of the attaching portion is out of the target range, the controller changes the pressure value to another value and executes the cutting processing while causing the pressure changer to apply, to the attaching portion, the pressure corresponding to the other value.

24 Claims, 16 Drawing Sheets

(58) Field of Classification Search
CPC ..... B26D 7/28; B26D 7/2635; B26D 7/26; B26D 7/2628; B26D 7/22; B26D 5/12; B26F 1/3826
USPC ..... 83/76.7, 368; 700/97
See application file for complete search history.

(56) References Cited

U.S. PATENT DOCUMENTS

| | | | | |
|---|---|---|---|---|
| 2014/0000429 | A1* | 1/2014 | Fujihara | B26D 5/00 83/76.6 |
| 2014/0182432 | A1* | 7/2014 | Muto | B26D 5/005 83/76.7 |
| 2015/0120030 | A1* | 4/2015 | Nagai | B26D 5/007 700/97 |
| 2016/0031109 | A1* | 2/2016 | Abe | B26D 7/2614 83/75.5 |
| 2017/0066152 | A1* | 3/2017 | Yamamoto | B26D 5/00 |

FOREIGN PATENT DOCUMENTS

| | | | |
|---|---|---|---|
| JP | 2002-127092 | A | 5/2002 |
| JP | 2002-172590 | A | 6/2002 |
| JP | 2003-220594 | A | 8/2003 |
| JP | 2012213846 | A | 11/2012 |
| JP | 2005-230917 | A | 1/2014 |
| JP | 2014-008557 | A | 1/2014 |

OTHER PUBLICATIONS

International Search Report issued in connection with PCT/JP2019/012758, dated Jun. 25, 2019.

Japanese Office Action dated Nov. 30, 2021, in corresponding Japanese application No. 2018-151999 (9 pages).

* cited by examiner

CUTTING APPARATUS

CROSS-REFERENCE TO RELATED APPLICATION

This is a continuation application of International Application No. PCT/JP2019/012758 filed on Mar. 26, 2019 which claims priority from Japanese Patent Application No. 2018-151999 filed on Aug. 10, 2018. The entire contents of the earlier applications are incorporated herein by reference.

TECHNICAL FIELD

Aspects disclosed herein relate to a cutting apparatus that cuts a sheet-like workpiece based on cutting data.

BACKGROUND

A known cutting apparatus cuts out a pattern from a sheet-like workpiece using a cutting blade by moving the workpiece and the cutting blade relative to each other. In the cutting apparatus, a blade protruding amount is set so that, in response to the cutting blade being press-contacted with the workpiece, a cutting edge of the cutting blade can penetrate the workpiece adhesively supported by a holding member.

SUMMARY

In a case where a workpiece has different stiffnesses or thicknesses in different portions, such a known cutting apparatus might not enable the cutting edge of the cutting blade to be located at an appropriate position relative to the workpiece. This may cause inappropriate cutting with respect to the workpiece.

Accordingly, aspects of the disclosure provide a cutting apparatus that may adjust a position of a cutting edge of a cutting blade relative to a workpiece more appropriately during execution of cutting processing than a known cutting apparatus.

In one or more aspects of the disclosure, a cutting apparatus may include a platen, an attaching portion, a first moving mechanism, a second moving mechanism, a pressure changer, and a controller. The attaching portion may be configured to hold a cutting blade. The first moving mechanism may be configured to move a workpiece supported by the platen and the attaching portion relative to each other in a first direction and a second direction. The second direction may intersect the first direction. The second moving mechanism may be configured to move the attaching portion in a third direction and a fourth direction. The third direction may intersect the first and second directions. The third direction may be a direction in which the second moving mechanism moves the attaching portion toward the platen. The fourth direction may intersect the first and second directions. The fourth direction may be a direction in which the second moving mechanism moves the attaching portion away from the platen. The pressure changer may be configured to, in response to movement of the attaching portion caused by the second moving mechanism, change magnitude of pressure to be applied to the attaching portion in the third direction. The controller may be configured to control the first moving mechanism and the second moving mechanism. The controller may be configured to execute data obtainment, pressure specification, target range specification, cutting control, and position obtainment. The data obtainment may include obtaining cutting data representing a pattern to be cut in the workpiece. The pressure specification may include specifying a pressure value corresponding to the pressure to be applied to the attaching portion by the pressure changer during execution of cutting processing for cutting the workpiece based on the obtained cutting data. The target range specification may include specifying a target range defining a range of target positions of the attaching portion in a fifth direction during execution of the cutting processing. The fifth direction may include the third direction and the fourth direction. The cutting control may include controlling the first moving mechanism while the second moving mechanism, thereby executing cutting processing for cutting the workpiece using the cutting blade held by the attaching portion. Controlling the first moving mechanism may include moving the workpiece supported by the platen and the attaching portion relative to each other in the first direction and the second direction. Controlling the second moving mechanism may include causing the pressure changer to apply, to the attaching portion, the pressure corresponding to the pressure value specified in the pressure specification. The position obtainment may include obtaining the position of the attaching portion in the fifth direction during execution of the cutting processing in the cutting control. The controller may be further configured to execute pressure change in a case where the position of the attaching portion in the fifth direction obtained in the position obtainment is out of the target range. The pressure change may include changing the pressure value specified in the pressure specification to a particular pressure value different from the current pressure value. The controller may be further configured to, in a case where the pressure value specified in the pressure specification is changed to the particular pressure value in the pressure change, execute the cutting control while causing the pressure changer to apply, to the attaching portion, the pressure corresponding to the particular pressure value.

In the cutting apparatus according to the disclosure, the controller may obtain the position of the attaching portion in the fifth direction during execution of the cutting processing. In a case where the obtained position of the attaching portion is out of the target range, the pressure changer may change the pressure applied to the attaching portion. Thus, as compared with a case where a constant pressure is applied to the attaching portion by the pressure changer during execution of the cutting processing without consideration of the position of the attaching portion in the fifth direction during executing of the cutting processing, in the cutting apparatus, the position of the cutting edge of the cutting blade relative to a workpiece may be adjusted appropriately.

DETAILED DESCRIPTION

Figure 1:
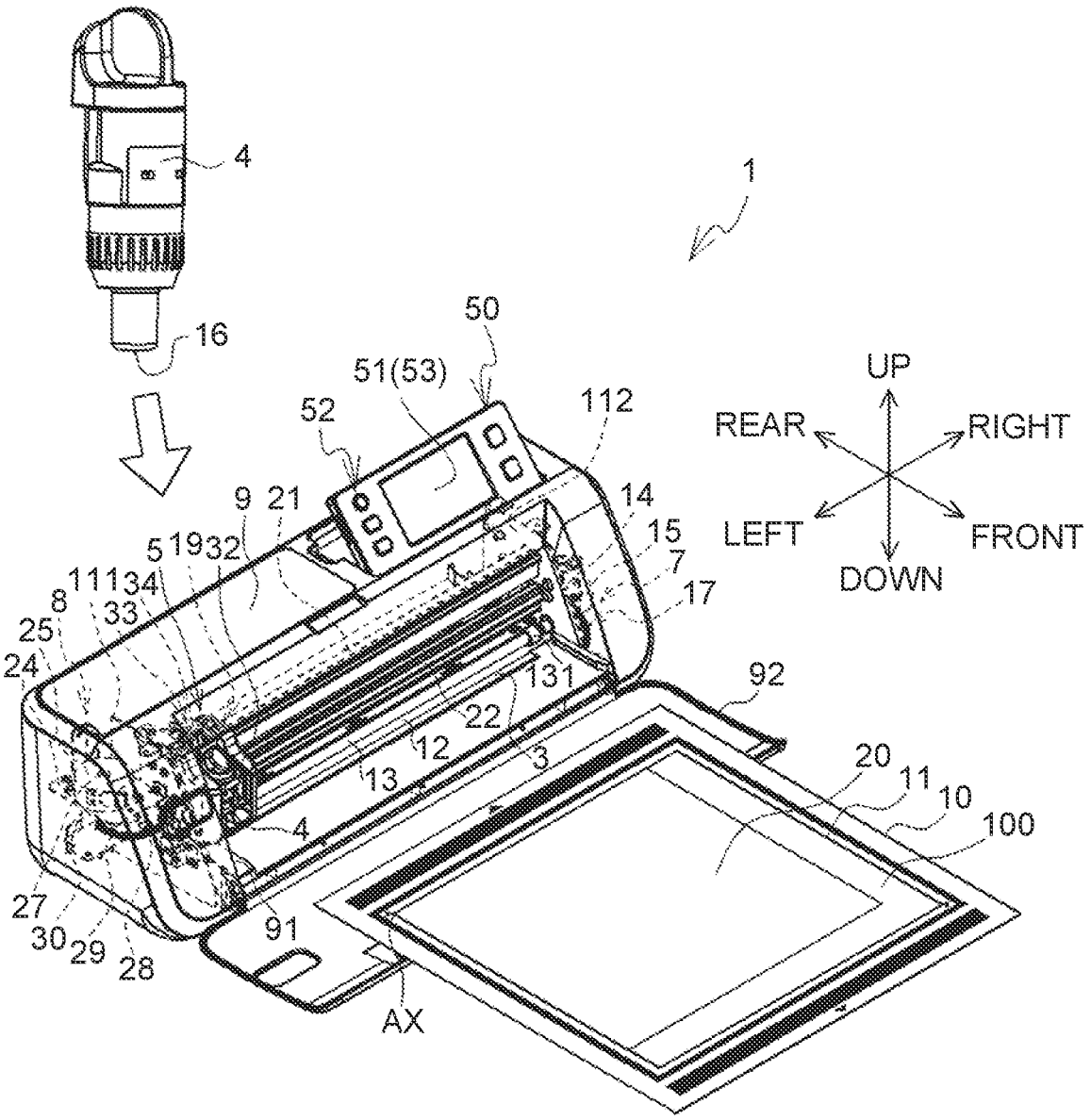
FIG. 1 is a perspective view of a cutting apparatus according to one or more of first, second, and third illustrative embodiments of the disclosure.

Illustrative embodiments of the disclosure will be described with reference to the accompanying drawings. The drawings to be referred to are used for explaining technical features employable in the disclosure. Configurations of devices, apparatuses, and systems, and flowcharts of various processing illustrated in the drawings are not intended to limit the disclosure thereto but are merely examples.

Figure 2:
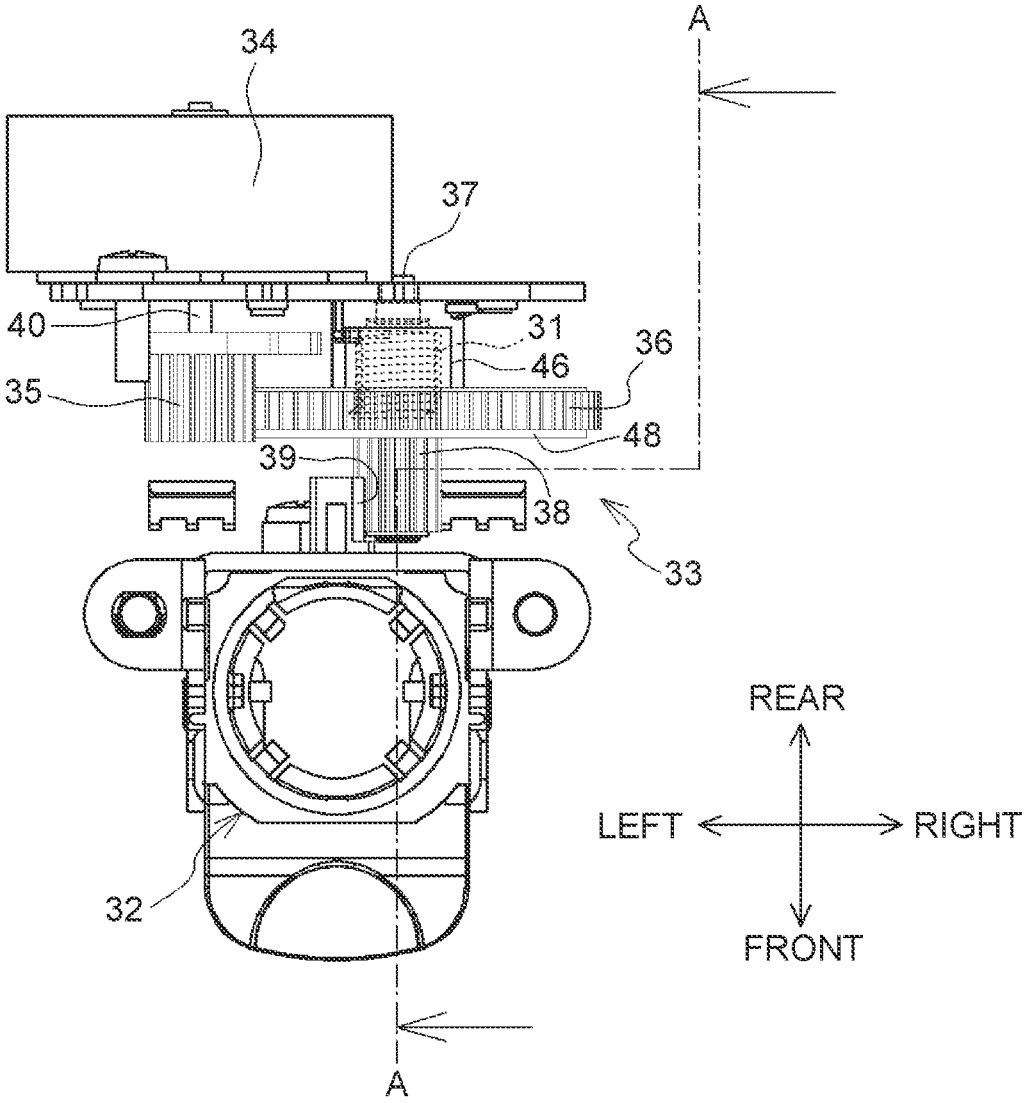
FIG. 2 is a top plan view of an attaching portion and an up-down drive mechanism of the cutting apparatus according to one or more of the first, second, and third illustrative embodiments of the disclosure.
Figure 3:
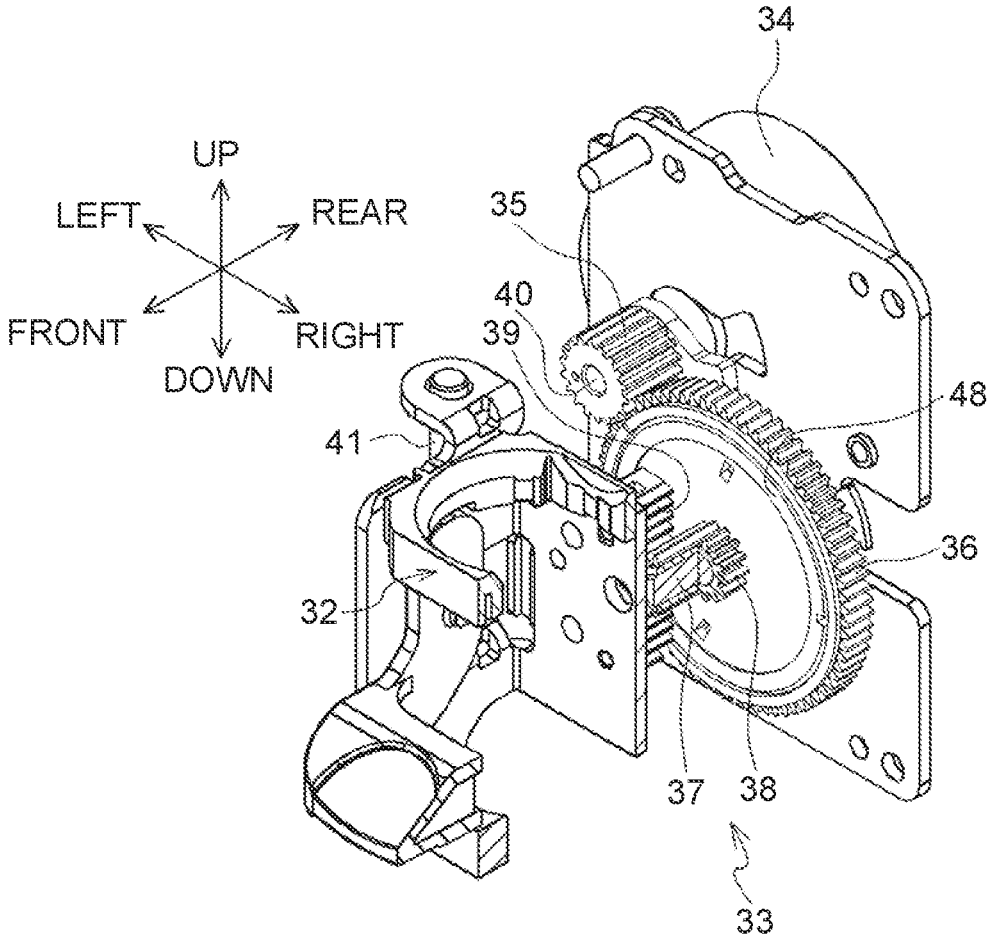
FIG. 3 is a partial sectional perspective view of the attaching portion and the up-down drive mechanism taken along line A-A of FIG. 2 according to one or more of the first, second, and third illustrative embodiments of the disclosure.

Referring to FIGS. 1, 2, and 3, a description will be provided on a common physical configuration of a cutting apparatus 1 among first, second, and third illustrative embodiments. In the following description, lower left, upper right, lower right, upper left, upper side, and lower side of the page of FIG. 1 may be defined respectively as left, right, front, rear, upper side and lower side of the cutting apparatus 1. That is, an extending direction of a casing 9 extends corresponds to a right-left direction. A surface of the cutting apparatus 1, in which an operation interface 50 is provided, may be an upper surface of the cutting apparatus 1. A front-rear direction, a right-left direction, a downward direction, an upward direction, and an up-down direction may be also referred to as a first direction, a second direction, a third direction, a fourth direction, and a fifth direction, respectively. In the description, an expression indicating a time period used with a specific condition includes a moment when the specific condition is satisfied and a period including a moment when it is determined that the specific condition is substantially satisfied and time before and after the moment.

As illustrated in FIG. 1, the cutting apparatus 1 is configured to, based on cutting data, cut one or more patterns in a sheet-like workpiece 20. More specifically, for example, in a state where the workpiece 20 is held by a holding member 10, the cutting apparatus 1 cuts the workpiece 20. The holding member 10 may have a rectangular shape and a certain thickness. In one example, the holding member 10 may be, for example, a mat made of synthetic resin. In another example, the holding member 10 may be a releasable sheet to which a workpiece 20 such as a sticker or label is adhered. The holding member 10 has a rectangular border 11 printed on its upper surface 18 (e.g., a first surface). The holding member 10 has a cutting area in which the cutting apparatus 1 can cut a workpiece 20. The cutting area may be a substantially rectangular area defined inside the border 11. That is, the cutting area excludes a peripheral portion of the holding member 10 outside the border 11 and the border 11 itself. The holding member 10 has an adhesive coating 100 applied in the cutting area. The adhesive coating 100 is provided by application of adhesive. A workpiece 20 may be a sheet-like member such as a cloth or a sheet of paper having a front surface 23 and a back surface opposite to the front surface 23. A workpiece 20 may be held by the holding member 10 such that the front surface 23 of the workpiece 20 faces upward and the back surface of the workpiece 20 is adhered to the upper surface 18 (e.g., the first surface) of the holding member 10 via the adhesive coating 100. The front surface 23 of the workpiece 20 may face an attaching portion 32 in the fifth direction during execution of cutting processing. The cutting apparatus 1 includes the casing 9, a platen 3, a head 5, a conveying mechanism 7, and a head moving mechanism 8. The conveying mechanism 7 and the head moving mechanism 8 are an example of a first moving mechanism.

The casing 9 may have a substantially box-like shape elongated in the right-left direction. The casing 9 includes an opening 91, a cover 92, and the operation interface 50. The casing 9 has the opening 91 at its front portion. The cover 92 may be a plate-like member elongated in the right-left direction. The cover 92 has a lower end pivotably supported by the casing 9. The cover 92 is configured to be opened to uncover the opening 91. The cover 92 is further configured to be closed to cover the opening 91. In FIG. 1, the cover 92 is opened to uncover the opening 91.

The operation interface 50 is disposed at a right portion of the upper surface of the casing 9. The operation interface 50 includes a liquid crystal display ("LCD") 51, a plurality of operating buttons 52, and a touch screen 53. The LCD 51 is configured to display images representing various items such as commands, illustrations, setting values, and messages. The touch screen 53 is disposed on a surface of the LCD 51. A user is enabled to press the touch screen 53 with a finger or stylus. Hereinafter, such a user's operation is referred to as a touch-screen operation. The cutting apparatus 1 is configured to determine, based on a pressed position detected by the touch screen 53, an item that has been selected. The user is enabled to, for example, select one or more patterns from various patterns displayed on the LCD 51, specify parameters, and input instructions, using one or more of the operating buttons 52 and the touch screen 53.

The platen 3 is disposed inside the casing 9. The platen 3 may be a plate-like member elongated in the right-left direction. The platen 3 is configured to receive a lower surface of the holding member 10 and support the holding member 10 that may hold a workpiece 20. More specifically, for example, the platen 3 has an upper surface 26 (e.g., a second surface). The upper surface 26 of the platen 3 is configured to support the lower surface of the holding member 10. In a state where the cover 92 is opened to uncover the opening 91, the holding member 10 is allowed to be placed on the platen 3. The position of the upper surface 26 of the platen 3 in the fifth direction may be also referred to as a platen position PP.

The head 5 includes a carriage 19, the attaching portion 32, a sensor 41, and an up-down drive mechanism 33. The up-down drive mechanism 33 is an example of a second moving mechanism. The attaching portion 32 and the up-down drive mechanism 33 are disposed on opposite sides of the carriage 19 in the front-rear direction. The attaching portion 32 is configured to hold a cutting blade 16. In the illustrative embodiment, for example, the cutting blade 16 is attached to a cartridge 4. The cartridge 4 holds a proximal end portion of the cutting blade 16. The attaching portion 32 holds the cutting blade 16 via the cartridge 4. Nevertheless, in other embodiments, for example, the attaching portion 32 may hold the proximal end portion of the cutting blade 16 directly. The cartridge 4 is configured to, in a state where the cartridge 4 has the cutting blade 16 at its lower end, be detachably attached to the attaching portion 32. The sensor 41 may be a position sensor configured to output a signal indicating the position of the attaching portion 32 in the fifth direction (hereinafter, also simply referred to as a fifth-direction position of the attaching portion 32). As illustrated in FIG. 3, the sensor 41 is disposed to the left rear of the attaching portion 32.

The up-down drive mechanism 33 is configured to move the attaching portion 32 in the third direction and the fourth direction. The third direction and the fourth direction may each be orthogonal to the first direction and the second direction. The third direction may be a direction in which the up-down drive mechanism 33 moves the attaching portion 32 toward the platen 3. The fourth direction may be a direction in which the up-down drive mechanism 33 moves the attaching portion 32 away from the platen 3. In the illustrative embodiments, the up-down drive mechanism 33 includes a Z-axis motor 34 and a transmission unit connected to an output shaft 40 of the Z-axis motor 34. The up-down drive mechanism 33 is configured such that the transmission unit decelerates rotating motion of the Z-axis motor 34, converts the rotating motion into up-down motion, and transmits the up-down motion to the attaching portion 32, thereby driving the attaching portion 32 and the cartridge 4 in the fifth direction (hereinafter, also referred to as a Z-axis direction). That is, the Z-axis motor 34 is configured to drive the attaching portion 32 and the cartridge 4 in the fifth direction. As illustrated in FIGS. 2 and 3, the up-down drive mechanism 33 includes gears 35 and 36, a shaft 37, a plate member 48, a pinion 38, and a rack 39 that constitute the transmission unit of the up-down drive mechanism 33. The gear 35 is fixed to a front end portion of the output shaft 40 of the Z-axis motor 34. The gear 35 is in mesh with the gear 36. The gear 35 has a dimeter smaller than a diameter of the gear 36. The gear 36 includes a tubular shaft 46 extending in the front-rear direction. The shaft 37 extends through the tubular shaft 46 of the gear 36. The output shaft 40 of the Z-axis motor 34 and the shaft 37 both extend in the front-rear direction.

The plate member 48 may have a disc-like shape having a diameter slightly smaller than the diameter of the gear 36. The plate member 48 has a front surface connected to a rear end of the pinion 38. The plate member 48 and the pinion 38 are in one piece and inseparable from each other. The plate member 48 and the gear 36 are separate components. The plate member 48 and the pinion 38 are configured to rotate independently of rotation of the gear 36. The pinion 38 and the plate member 48 are disposed further to the front than the gear 36. The shaft 37 extends through the pinion 38 and the plate member 48. The pinion 38 and the plate member 48 are configured to rotate relative to the shaft 37. The pinion 38 has a dimeter smaller than the respective diameters of the gears 35 and 36. The rack 39 extends in the up-down direction and has teeth on its right surface. The rack 39 is in mesh with the pinion 38 via their interlocking teeth. The rack 39 is fixed to the back of the attaching portion 32.

The up-down drive mechanism 33 further includes a pressure changer 31. The pressure changer 31 is configured to change magnitude of pressure applied to the attaching portion 32 in the third direction (e.g., a downward pressure applied to the attaching portion 32) (hereinafter, simply referred to as a third-direction pressure). In the illustrative embodiments, the pressure changer 31 may be, for example, a torsion spring disposed in the shaft 46 of the gear 36. The pressure changer 31 has one end fixed to the shaft 46 and the other end fixed to the plate member 48. The pressure changer 31 is configured to transmit rotation of the gear 36 to the plate member 48. The pressure changer 31 is further configured to, in response to change of a compression amount of the torsion spring serving as the pressure changer 31 in accordance with rotation of the gear 36, change magnitude of a third-direction pressure applied to the attaching portion 32. In other words, in accordance with rotation of the shaft 46 due to rotation of the gear 36, the compression amount of the torsion spring serving as the pressure changer 31 whose one end is connected to the shaft 46 changes. Thus, a rotation force of the plate member 48 to which the other end of the pressure changer 31 is connected changes. In response to change of the rotation force of the plate member 48, the third-direction pressure applied to the attaching portion 32 changes.

As the output shaft 40 of the Z-axis motor 34 rotates clockwise, the gear 35 rotates clockwise and the gear 36 rotates counterclockwise. In response, the pressure changer 31 transmits rotation of the gear 36 to the plate member 48. In a state where the cutting blade 16 is out of contact with a workpiece 20 or the holding member 10, pressure acting in the fourth direction (hereinafter, simply referred to as a fourth-direction pressure) (e.g., an upward pressure) does not exert on the attaching portion 32. Thus, in response to receiving rotation of the gear 36 transmitted from the pressure changer 31, the plate member 48 and the pinion 38 rotate counterclockwise respectively by an amount corresponding to the rotation of the gear 36. In a state where the cutting blade 16 is in contact with a workpiece 20 or the holding member 10, the attaching portion 32 receives a fourth-direction pressure via the cutting blade 16. Thus, even when the plate member 48 receives rotation of the gear 36 transmitted from the pressure changer 31, the plate member 48 and the pinion 38 do not rotate unless the third-direction pressure applied to the attaching portion 32 exceeds the fourth-direction pressure applied to the attaching portion 32. As the output shaft 40 of the Z-axis motor 34 rotates clockwise in such a state, the gear 36 rotates relative to the plate member 48 and the pinion 38 and torsion of the pressure changer 31 increases. In response to this, the third-direction pressure applied to the attaching portion 32 by the pressure changer 31 via the plate member 48 and the pinion 38 increases. In a case where the third-direction pressure applied to the attaching portion 32 by the pressure changer 31 exceeds the fourth-direction pressure applied to the attaching portion 32, the pinion 38 starts rotating and the attaching portion 32 moves in the third direction (e.g., downward). The rotation amount of the pinion 38 may differ from or may be equal to the rotation amount of the gear 36. As the output shaft 40 of the Z-axis motor 34 rotates counterclockwise, the gear 35 rotates counterclockwise and the gear 36 and the pinion 38 rotate clockwise. At that time, the attaching portion 32 moves in the fourth direction (e.g., upward) together with the rack 39. The cartridge 4 attached to the attaching portion 32 moves between a cutting position and a raised position in accordance with driving of the Z-axis motor 34. The cutting position is to be determined in cutting processing. The cutting position refers to a particular position of the attaching portion 32 in the fifth direction when the cutting apparatus 1 performs cutting on a workpiece 20 based on cutting data. The raised position refers to another particular position of the attaching portion 32 in the fifth down direction where the attaching portion 32 is spaced from a workpiece 20 by a predetermined distance in the fifth direction.

The rotation amount of the Z-axis motor 34 is in correlation to a third-direction pressure applied to the attaching portion 32 by the pressure changer 31 in a case where the cutting blade 16 contacts a workpiece 20 or the holding member 10. In the illustrative embodiments, the Z-axis motor 34 may be a pulse motor, and a rotation angle of the output shaft 40 of the Z-axis motor 34 is proportional to a pulse input to the Z-axis motor 34. Thus, the number of pulses input to the Z-axis motor 34 is in correlation to pressure acting toward the platen 3 applied to the attaching portion 32 by the pressure changer 31. In the illustrative embodiments, the number of pulses input to the Z-axis motor 34 is used as a pressure value that corresponds to the magnitude of a third-direction pressure applied to the attaching portion 32 by the pressure changer 31.

The conveying mechanism 7 and the head moving mechanism 8 are configured to respectively move the holding member 10 placed on the platen 3 and the attaching portion 32 relative to each other in the first direction and the second direction orthogonal to the first direction. The conveying mechanism 7 is configured to convey the holding member 10 placed on the platen 3 in the front-rear direction (hereinafter, also referred to as a Y-axis direction) in the cutting apparatus 1. The conveying mechanism 7 includes a drive roller 12, a pinch roller 13, a mount frame 14, a Y-axis motor 15, and a decelerator 17. The casing 9 further includes therein inner walls 111 and 112 facing each other. The inner wall 111 is disposed to the left of the platen 3. The inner wall 112 is disposed to the right of the platen 3. The drive roller 12 and the pinch roller 13 are disposed between and rotatably supported by the inner walls 111 and 112. The drive roller 12 and the pinch roller 13 are configured to convey the holding member 10 in the first direction (e.g., the Y-axis direction) relative to the attaching portion 32. The drive roller 12 and the pinch roller 13 both extend in the right-left direction (hereinafter, also referred to as an X-axis direction) of the cutting apparatus 1, and disposed next to each other in the up-down direction. The pinch roller 13 includes a roller portion at its left end portion and a roller portion 131 at its right end portion.

The inner wall 112 has opposite surfaces in the right-left direction. The left surface of the inner wall 112 faces the inner wall 111. The mount frame 14 is fixed to the right surface of the inner wall 112. The Y-axis motor 15 is mounted to the mount frame 14. The Y-axis motor 15 may be, for example, a pulse motor. The Y-axis motor 15 includes an output shaft connected to a drive gear of the decelerator 17. The drive gear of the decelerator 17 is in mesh with a driven gear. The driven gear is fixed to a right end of the drive roller 12.

When the conveying mechanism 7 conveys the holding member 10, the drive roller 12 and the left roller portion of the pinch roller 13 pinch therebetween a left end portion of the holding member 10 and the drive roller 12 and the right roller portion 131 of the pinch roller 13 pinch therebetween a right end portion of the holding member 10. In response to the Y-axis motor 15 rotating in a forward direction or in a reverse direction, the rotating motion of the Y-axis motor 15 is transmitted to the drive roller 12 via the decelerator 17. That is, the Y-axis motor 15 drives the drive roller 12. The holding member 10 is thus conveyed frontward or backward in a conveyance direction in accordance with the rotating direction of the Y-axis motor 15.

The head moving mechanism 8 is configured to move the head 5 in a direction intersecting the conveyance direction of the holding member 10, that is, in the X-axis direction. In other words, the moving direction of the head 5 is orthogonal to the conveyance direction of the holding member 10. The head moving mechanism 8 includes a pair of upper and lower guide rails 21 and 22, a mount frame 24, an X-axis motor 25, a drive gear 27, a driven gear 29, and a transmission mechanism 30. The drive gear 27 and the driven gear 29 constitute a decelerator. The guide rails 21 and 22 are fixed between the inner walls 111 and 112. The guide rails 21 and 22 are disposed above to the rear of the pinch roller 13. The guide rails 21 and 22 both extend substantially parallel to the pinch roller 13, that is, extend in the X-axis direction. The carriage 19 of the head 5 is supported by the guide rails 21 and 22 so as to be movable in the X-axis direction along the guide rails 21 and 22.

The inner wall 111 has opposite surfaces in the right-left direction. The right surface of the inner wall 111 faces the inner wall 112. The mount frame 24 is fixed to the left surface of the inner wall 111. The X-axis motor 25 is disposed at a rear portion of the mount frame 24 and faces downward. The drive gear 27 is fixed to an output shaft of the X-axis motor 25. The X-axis motor 25 may be, for example, a pulse motor. The driven gear 29 is in mesh with the drive gear 27. The transmission mechanism 30 includes a pair of right and left timing pulleys including a timing pulley 28, and an endless timing belt looped around the timing pulleys. The timing pulley 28 (e.g., the left timing pulley) is disposed at the mount frame 24 so as to be rotatable together with the driven gear 29. The other timing pulley (e.g., the right timing pulley) is disposed at the mount frame 14. The timing belt extends in the X-axis direction and is connected to the carriage 19.

The head moving mechanism 8 is configured to convert rotating motion of the X-axis motor 25 into linear motion in the X-axis direction and transmit the linear motion to the carriage 19. In response to the X-axis motor 25 rotating in a forward direction or in a reverse direction, the rotating motion of the X-axis motor 25 is transmitted to the timing belt via the drive gear 27, the driven gear 29, and the timing pulley 28. The carriage 19 thus moves leftward or rightward correspondingly. Thus, the head 5, and more specifically, the attaching portion 32, moves in the second direction (e.g., the X-axis direction) relative to the holding member 10 by driving of the X-axis motor 25.

Figure 4:
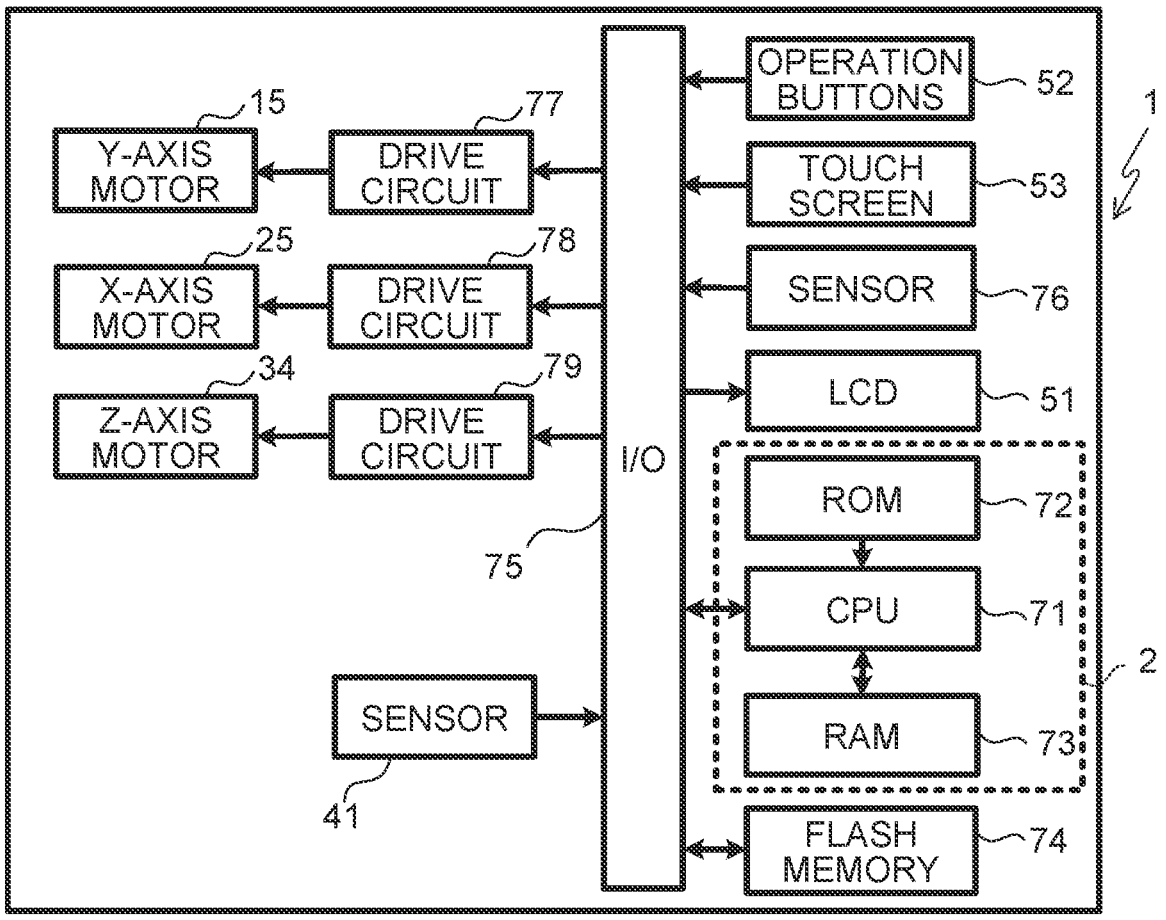
FIG. 4 is a block diagram of an electrical configuration of the cutting apparatus according to one or more of the first, second, and third illustrative embodiments of the disclosure.

Referring to FIG. 4, a description will be provided on an electrical configuration of the cutting apparatus 1 according to the first, second, and third illustrative embodiments. The cutting apparatus 1 includes a CPU 71, a ROM 72, a RAM 73, and an input/output ("I/O") interface 75. The CPU 71 is electrically connected to the ROM 72, the RAM 73, and the I/O interface 75. The CPU 71, the ROM 72, and the RAM 73 serve as a controller 2 that mainly controls the cutting apparatus 1. The ROM 72 stores various programs for operating the cutting apparatus 1. The programs include, for example, a program for enabling the cutting apparatus 1 to execute main processing. The RAM 73 is configured to temporarily store various programs and data, setting values input using one or more of the operating buttons 52, and calculation results obtained by the CPU 71 in calculation processing.

A flash memory 74, the operating buttons 52, the touch screen 53, a sensor 76, the sensor 41, the LCD 51, and drive circuits 77, 78, and 79 are connected to the I/O interface 75. The flash memory 74 may be a nonvolatile storage device that stores, for example, various parameters.

The sensor 76 is configured to detect a leading end of the holding member 10 set on the platen 3 to output a detection signal. A detection signal output by the sensor 76 is input to the controller 2. The sensor 41 is configured to output a signal indicating the position of the attaching portion 32 in the fifth direction. In the illustrative embodiments, the controller 2 is configured to determine, based on an output of the sensor 41, the position of the attaching portion 32 in the fifth direction (hereinafter, also referred to as the height of the attaching portion 32) with reference to the position of the upper surface 26 of the platen 3. Nevertheless, in other embodiments, for example, another suitable reference may be used for determining the position of the attaching portion 32 in the fifth direction. The controller 2 is configured to control the LCD 51 to display one or more images thereon. The LCD 51 is configured to display thereon various instructions. The drive circuits 77, 78, and 79 are configured to drive the Y-axis motor 15, the X-axis motor 25, and the Z-axis motor 34, respectively. The controller 2 is further configured to, based on cutting data, control the Y-axis motor 15, the X-axis motor 25, and the Z-axis motor 34 to perform automatic cutting on a workpiece 20 placed on the holding member 10. The cutting data includes coordinate data used for controlling the conveying mechanism 7 and the head moving mechanism 8. The coordinate data may be represented by a cutting coordinate system defined within the cutting area. The coordinate data includes relative positions of end points (hereinafter, also referred to as constituent points) of each of a plurality of line segments representing a pattern. In the illustrative embodiments, an origin AX of the cutting coordinate system may be defined at a left-rear corner of the rectangular cutting area. The right-left direction and the front-rear direction may be defined as the X-axis direction and the Y-axis direction, respectively.

Figure 5:
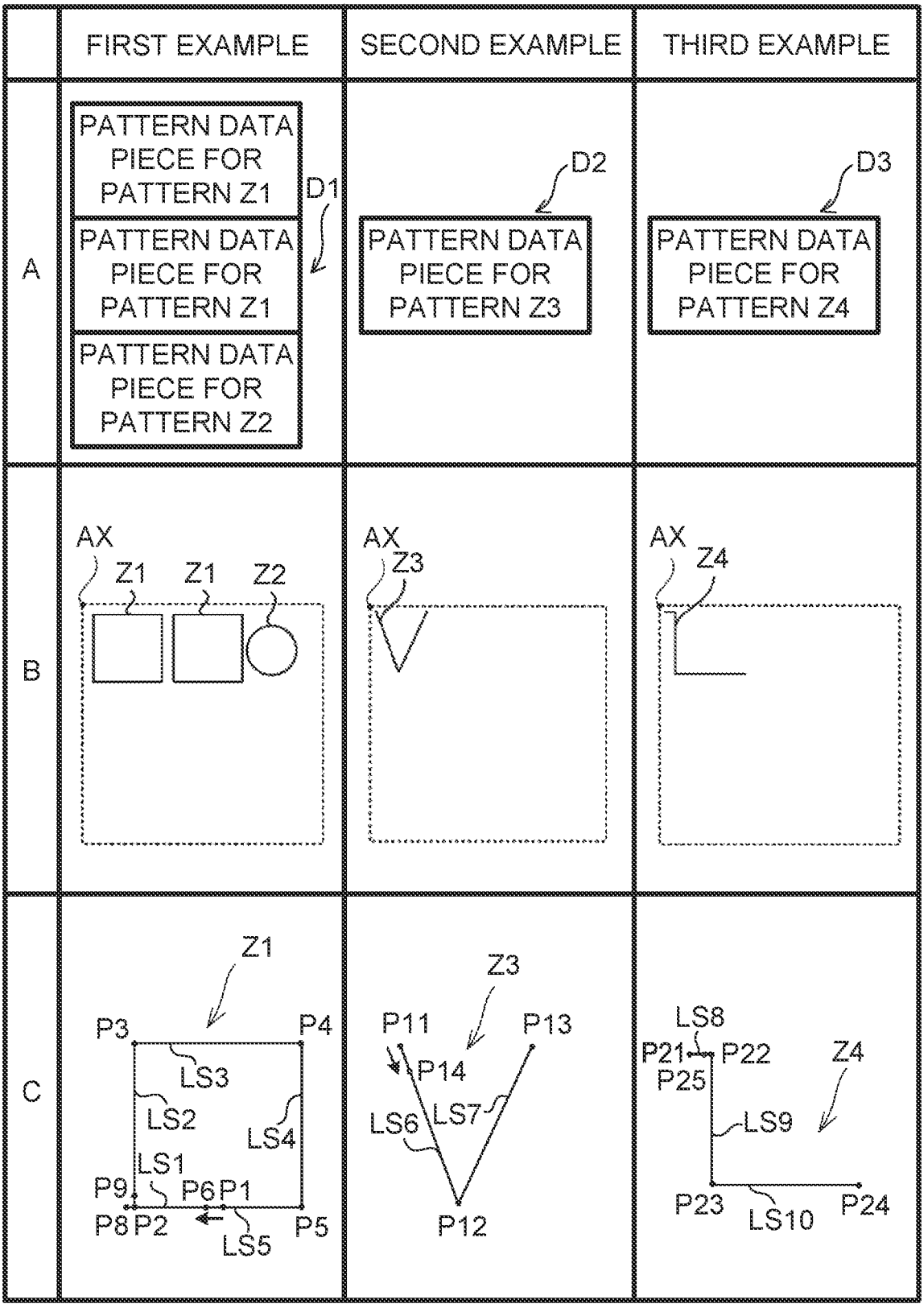
FIG. 5 is a chart for explaining first, second, and third examples according to one or more of the first, second, and third illustrative embodiments of the disclosure.

Referring to FIGS. 5 to 11, a description will be provided on the main processing according to the first illustrative embodiment. In response to receiving a start instruction by a touch-screen operation, the controller 2 of the cutting apparatus 1 reads out a certain program from the flash memory 74 to store the read program in the RAM 73 and executes the main processing in accordance with instructions included in the read program. A description will be provided on first, second, and third examples in which, as illustrated in FIG. 5, cutting data D1, D2, and D3 are respectively obtained. Although the main processing is executed at respective different timings in the first, second, and third examples, they will be described in parallel for the sake of simplicity. Various thresholds used in the main processing may be preassigned in consideration of cutting conditions or may be specified by the user.

Figure 6:
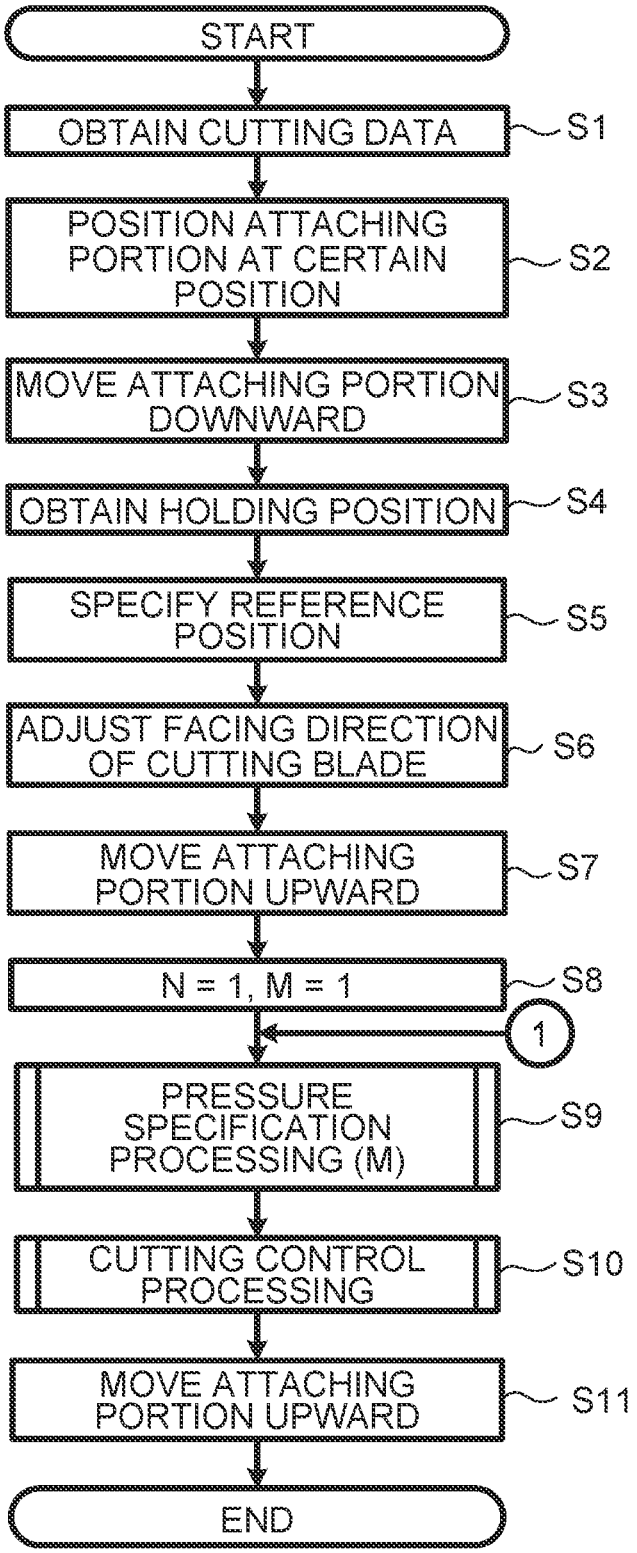
FIG. 6 is a flowchart of main processing according to one or more of the first, second, third illustrative embodiments of the disclosure.

As illustrated in FIG. 6, in the main processing, the controller 2 obtains cutting data (e.g., step S1). The cutting data includes one or more pattern data pieces representing one or more particular patterns to be cut in a workpiece 20. The processing for obtaining cutting data may be appropriately executed according to a known procedure. More specifically, for example, as illustrated in a row A of FIG. 5, in the first example, the controller 2 obtains cutting data D1. The cutting data D1 may include, for example, two pattern data pieces each representing a quadrangular pattern Z1 and a pattern data piece representing a circular pattern Z2. In the second example, the controller 2 obtains cutting data D2. The cutting data D2 may include, for example, a pattern data piece representing a V-shaped pattern Z3. In the third example, the controller 2 obtains cutting data D3. The cutting data D3 may include, for example, a pattern data piece representing a Z-shaped pattern Z4. Subsequent to step S1, the controller 2 controls the drive circuits 77 and 78 to drive the Y-axis motor 15 and the X-axis motor 25, respectively, to control the conveying mechanism 7 and the head moving mechanism 8, thereby moving the attaching portion 32 relative to the holding member 10 to stop at a certain position (e.g., step S2). The controller 2 executes step S2 in a state where the cutting blade 16 attached to the attaching portion 32 is out of contact with the holding member 10 placed on the platen 3. In the first illustrative embodiment, the certain position may be an adjusting position in which known adjustment processing for adjusting a facing direction of a blade edge is executed. More specifically, for example, the certain position is included in an adjusting area that may be on a rear side of the border 11 (refer to FIG. 1).

Subsequent to step S2, the controller 2 controls the up-down drive mechanism 33 by driving the Z-axis motor 34 to move the attaching portion 32 downward toward the platen 3 in the certain position where the attaching portion 32 has been located in step S2 (e.g., step S3) and obtains a holding position HP (e.g., step S4). The holding position HP may refer to the position of the attaching portion 32 in the fifth position corresponding to a signal output by the sensor 41 when the cutting blade 16 contacts the holding member 10. More specifically, the controller 2 counts, as the pressure value, pulses input to the Z-axis motor 34 (i.e., the drive circuit 79) while moving the attaching portion 32 in the third direction. The controller 2 obtains, based on a signal output by the sensor 41, the height of the attaching portion 32 relative to the pressure value. In the first illustrative embodiment, as represented by a legend E0 in FIG. 10, the controller 2 moves the attaching portion 32 toward the platen 3 to obtain, as the holding position HP, the position at which the gradient of the line indicating the height of the attaching portion 32 relative to the pressure value changes. The holding position HP corresponds to the position of the upper surface 18 of the holding member 10 in the fifth direction. In response to detecting the change of the gradient of the line, the controller 2 controls the up-down drive mechanism 33 to stop the attaching portion 32 from moving in the third direction.

Subsequent to step S4, the controller 2 specifies a reference position RP based on the obtained holding position HP (e.g., step S5). In the first illustrative embodiment, the controller 2 assigns a particular position to the reference position RP. The particular position may be shifted in the third direction from the holding position HP obtained in step S4 by a certain distance less than a thickness (e.g., a dimension in the fifth direction) of the holding member 10. The thickness of the holding member 10 may be obtained based on output of the sensor 41 or prestored in the flash memory 74. The thickness of the holding member 10 may be, for example, 4.0 mm. The certain distance used in step S5 may be prestored in the flash memory 74 or may be specified by the user. The certain distance may be, for example, 1.0 mm.

Subsequent to step S5, in a state where the cutting blade 16 is in contact with the holding member 10 by execution of step S3, the controller 2 controls the conveying mechanism 7 and the head moving mechanism 8 to adjust the facing direction of the cutting edge of the cutting blade 16 within the adjusting area in the known manner (e.g., step S6). Subsequent to step S6, the controller 2 controls the up-down drive mechanism 33 to move the attaching portion 32 in the fourth direction (e.g., upward) to stop at the raised position (e.g., step S7). Subsequent to step S7, the controller 2 respectively assigns 1 (one) to a variable N and a variable M (e.g., step S8). The variable N is used for counting the number of times of cutting. The variable M is used for sequentially obtaining one or more pattern data pieces included in the cutting data obtained in step S1 in the order in which one or more patterns represented by the one or more respective pattern data pieces are to be cut in a workpiece 20 (hereinafter, also simply referred to as a cutting order).

Figure 7:
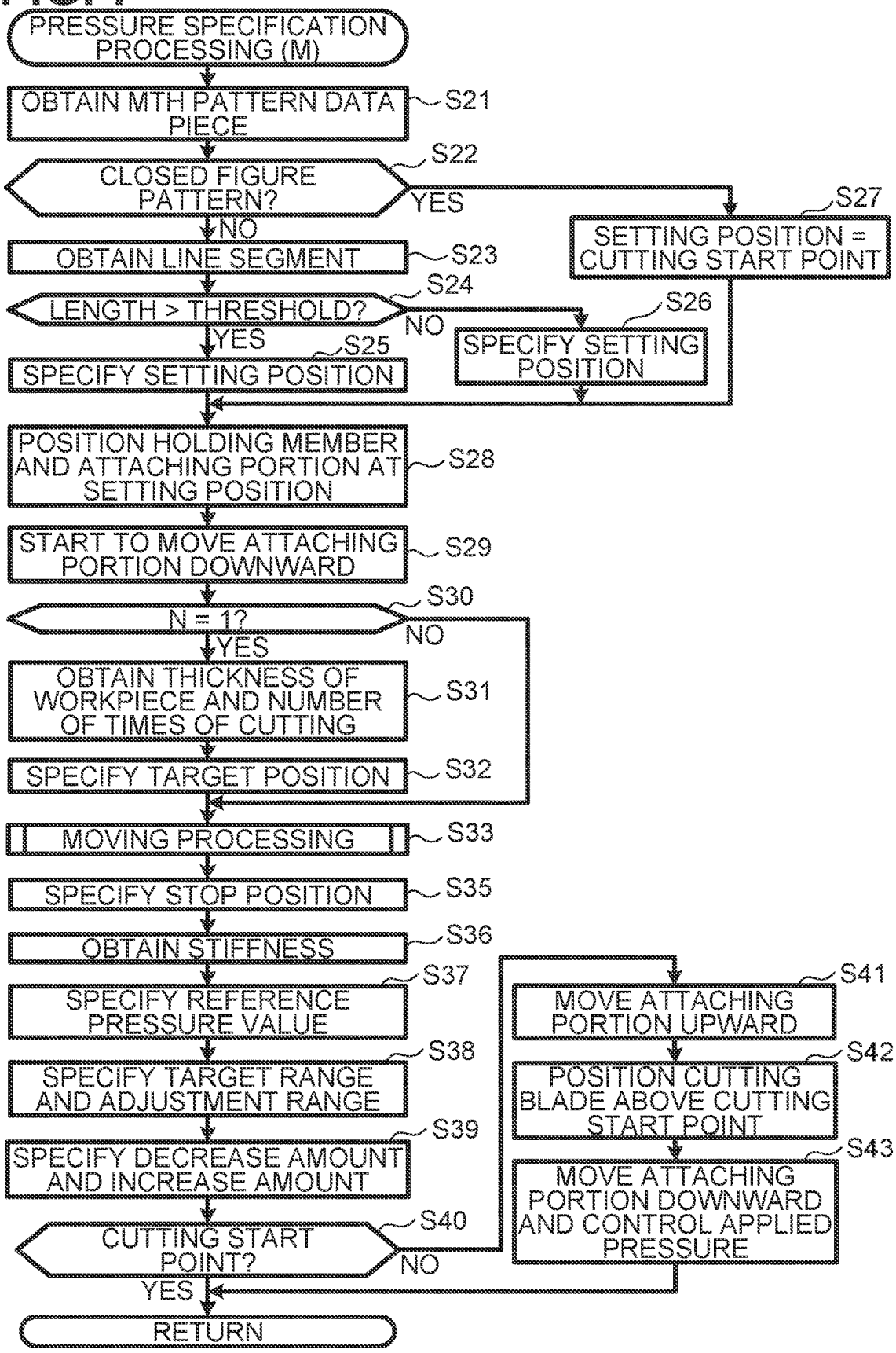
FIG. 7 is a flowchart of pressure specification processing for variable M executed in the main processing of FIG. 6 according to one or more of the first, second, third illustrative embodiments of the disclosure.

Subsequent to step S8, the controller 2 executes pressure specification processing for variable M (e.g., step S9). In a case where processing of step S9 is executed subsequent to step S8, the variable N is assigned 1 (one) and the variable M is also assigned 1 (one). As illustrated in FIG. 7, in the pressure specification processing for variable M, the controller 2 obtains an Mth pattern data piece in the cutting order among the one or more pattern data pieces included in the cutting data obtained in step S1 (e.g., step S21). More specifically, in the first example, the controller 2 obtains the first pattern data piece representing the pattern Z1 in the cutting order. In the second example, the controller 2 obtains the pattern data piece representing the pattern Z3. In the third example, the controller 2 obtains the pattern data piece representing the pattern Z4. Subsequent to step S21, the controller 2 determines whether the pattern represented by the Mth pattern data piece obtained in step S21 is a closed figure pattern (e.g., step S22). As illustrated in a row C of FIG. 5, in the first example, the pattern Z1 is a quadrangular pattern represented by line segments LS1 to LS5 each connecting between adjacent two of constituent points P1 to P6 in this order. That is, the pattern Z1 is a closed figure pattern (e.g., YES in step S22). In such a case, the controller 2 assigns a cutting start point P1 (refer to the row C of FIG. 5) to a setting position (e.g., step S27). The setting position may refer to a position where the attaching portion 32 is located when the pressure value corresponding to the pressure applied to the attaching portion 32 in the Nth cutting processing is specified and where the attaching portion 32 faces the workpiece 20 held by the holding member 10.

As illustrated in the row C of FIG. 5, in the second example, the pattern Z3 is a V-shaped pattern represented by line segments LS6 and LS7 each connecting between adjacent two of constituent points P11 to P13 in this order. In the third example, the pattern Z4 is a Z-shaped pattern represented by line segments LS8 to LS10 each connecting between adjacent two of constituent points P21 to P24 in this order. That is, neither the pattern Z3 nor the pattern Z4 is a closed figure pattern. In such a case, the controller 2 determines that the pattern represented by the Mth pattern data piece obtained in step S21 is not a closed figure pattern (e.g., NO in step S22). The controller 2 then obtains the line segment including a cutting start point among the line segments included in the Mth pattern data piece (e.g., step S23). More specifically, for example, the controller 2 obtains the line segment LS6 including a cutting start point P11 in the second example and the line segment LS8 including a cutting start point P21 in the third example. Subsequent to step S23, the controller 2 determines whether a length of the line segment obtained in step S23 is greater than a threshold (e.g., step S24). In the second example, the controller 2 determines that a length of the line segment obtained in step S23 (e.g., the line segment LS6) is greater than the threshold (e.g., YES in step S24). In such a case, the controller 2 assigns a setting position to a point P14 on the line segment LS6 (e.g., step S25). The point P14 is apart from the cutting start point P11 by a certain distance on the line segment LS6. The certain distance may be less than the threshold used in step S24 and greater than a half of the threshold. In the first illustrative embodiment, the certain distance is greater than the half of the threshold used in step S24. For example, the certain distance may be 3 mm and the threshold used in step S24 may be 4 mm. In the third example, the controller 2 determines that a length of the line segment obtained in step S23 (e.g., the line segment LS8) is less than or equal to the threshold (e.g., NO in step S24). In such a case, the controller 2 assigns a setting position to a point P25 on the line segment LS8 (e.g., step S26). The point P25 is apart from the cutting start point P21 by a certain degree on the line segment LS8. The certain degree may be a value smaller than 1 (one) and larger than 0.5, for example, 0.75.

Subsequent to step S25, S26, or S27, the controller 2 controls the conveying mechanism 7 and the head moving mechanism 8 to respectively move the holding member 10 and the attaching portion 32 relative to each other to position the holding member 10 and the attaching portion 32 at the setting position assigned in step S25, S26, or S27 (e.g., step S28). More specifically, in the first example, the controller 2 controls the conveying mechanism 7 and the head moving mechanism 8 to respectively move the attaching portion 32 and the holding member 10 relative to each other to position the cutting blade 16 above the cutting start point P1. In the second example, the controller 2 controls the conveying mechanism 7 and the head moving mechanism 8 to respectively move the attaching portion 32 and the holding member 10 relative to each other to position the cutting blade 16 above the point P14. In the third example, the controller 2 controls the conveying mechanism 7 and the head moving mechanism 8 to respectively move the attaching portion 32 and the holding member 10 relative to each other to position the cutting blade 16 above the point P25.

Subsequent to step S28, the controller 2 controls the up-down drive mechanism 33 to start to move the attaching portion 32 in the third direction (e.g., downward) in the setting position (e.g., step S29). Subsequent to step S29, the controller 2 determines whether the value of the variable N is equal to 1 (one) (e.g., step S30). In a case where the value of the variable N is greater than 1 (one), the controller 2 determines that the value of the variable N is not equal to 1 (one) (e.g., NO in step S30) and the routine proceeds to step S33. If the controller 2 determines that the value of the variable N is equal to 1 (one) (e.g., YES in step S30), the controller 2 obtains a thickness of the workpiece 20 and the number of times of cutting (e.g., step S31). Respective values for the thickness of the workpiece 20 and the number of times of cutting may be input by the user or assigned calculated values. In the first illustrative embodiment, the controller 2 obtains the thickness of the workpiece 20 based on change in a ratio of the height of the attaching portion 32 to the pressure value. Further, the controller 2 calculates the number of times of cutting based on the obtained thickness of the workpiece 20.

Figure 10:
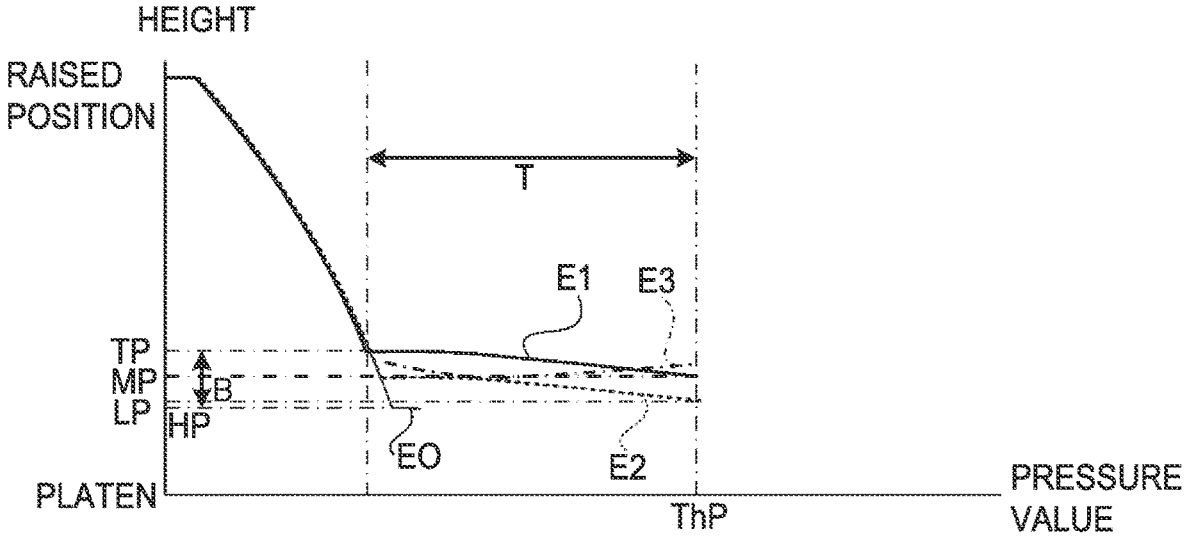
FIG. 10 is a graph showing changes in a pressure value relative to a height of the attaching portion when a holding position is obtained and when a reference pressure value for an Nth cutting process is specified according to one or more of the first, second, third illustrative embodiments of the disclosure.

More specifically, as illustrated in FIG. 10, the controller 2 counts, as the pressure value, pulses input to the Z-axis motor 34 (i.e., the drive circuit 79) while moving the attaching portion 32 in the third direction. The controller 2 obtains, based on a signal output by the sensor 41, the height of the attaching portion 32 relative to the pressure value. The controller 2 determines, based on output of the sensor 41, whether the gradient of the line indicating the position of the attaching portion 32 relative to the pressure value has changed. In the first illustrative embodiment, the controller 2 moves the attaching portion 32 toward the platen 3 to obtain a position TP at which the gradient of the line indicating the height of the attaching portion 32 relative to the pressure value changes. The controller 2 determines, based on the obtained position TP, a thickness B of the workpiece 20. The position TP corresponds to the position of the front surface 23 of the workpiece 20 in the fifth direction. The controller 2 determines the holding position HP obtained in step S4 and the position TP corresponding to the position of the front surface 23 of the workpiece 20, and then determines the thickness B of the workpiece 20 based on a difference between the position HP and the position TP. In each of the first, second, and third examples, the controller 2 determines 1.6 mm as the thickness B of the workpiece 20.

The number of times of cutting refers to how many times a series of steps included in the cutting processing need to be executed to cut one or more patterns fully in the fifth direction in the workpiece 20 based on the cutting data obtained in step S1. In the cutting processing, the controller 2 sequentially reads out coordinate data included in the cutting data and controls the conveying mechanism 7 and the head moving mechanism 8 to cut one or more patterns in the workpiece 20 using the cutting blade 16. One-time execution of the cutting processing includes the series of the steps including sequentially reading out all coordinate data included in cutting data and controlling the conveying mechanism 7 and the head moving mechanism 8 based on all the read coordinate data. That is, in a case where the cutting apparatus 1 cuts all line segments included in each of the one or more patterns indicated by the cutting data once, the number of times of cutting is counted as one time. The controller 2 calculates the number of times of cutting by dividing a difference between the position TP and the platen position PP assigned in step S5 by a thickness threshold (e.g., a threshold ThL) and rounding the result of the division up to the next whole number. The threshold ThL indicates an upper limit of a thickness of a workpiece 20 that can be cut in one-time execution of the cutting processing. For example, the threshold ThL may be 1 mm. For example, the number of times of cutting is calculated as two times in each of the first, second, and third examples.

Figure 8:
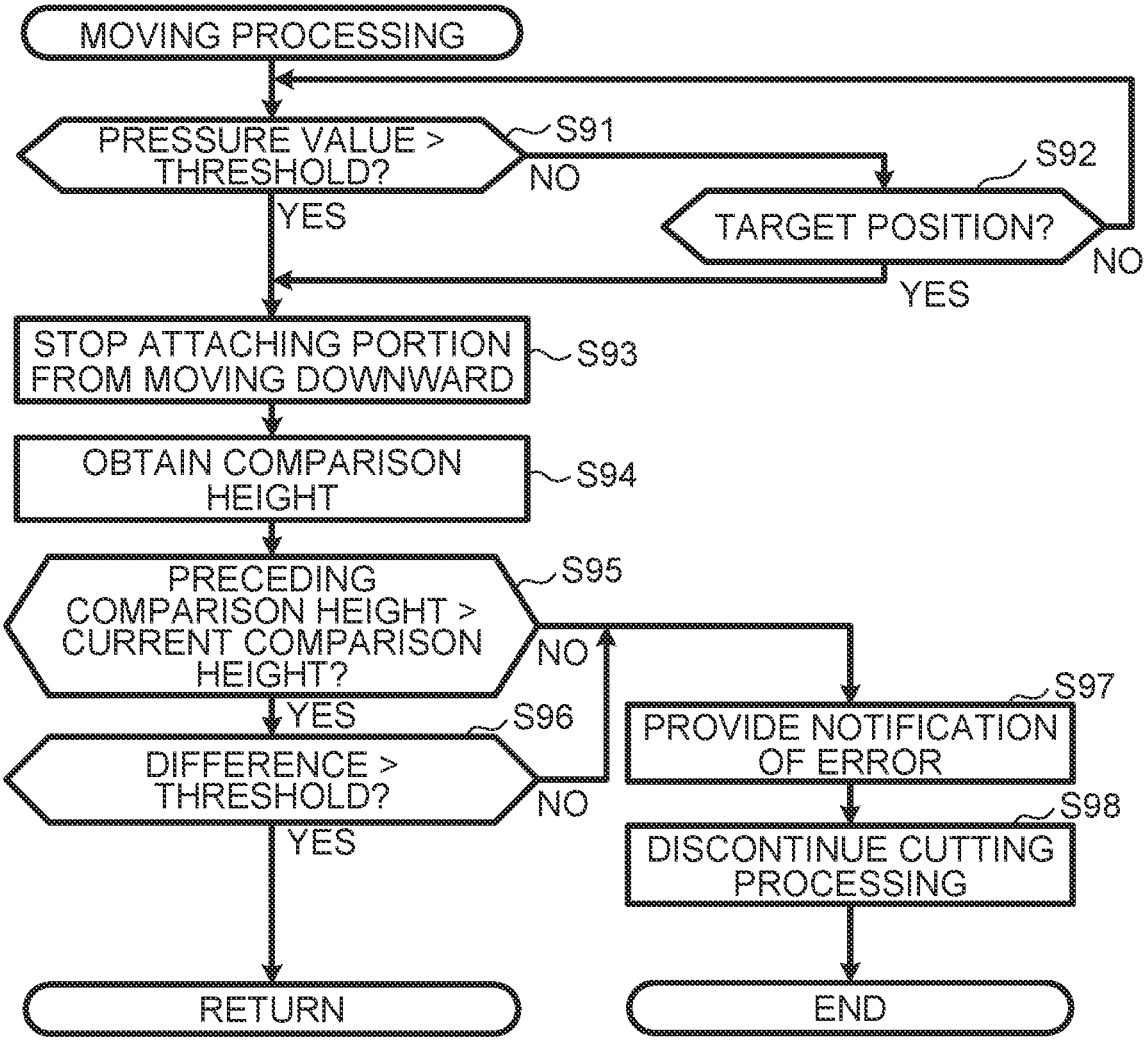
FIG. 8 is a flowchart of moving processing executed in the pressure specification processing for variable M of FIG. 7 according to one or more of the first, second, third illustrative embodiment of the disclosure.

Subsequent to step S31, based on the thickness obtained in step S31, the controller 2 specifies a target position for each time of cutting processing to be executed (e.g., step S32). More specifically, for example, the controller 2 assigns, to a target position, for each time of cutting processing to be executed other than the last cutting processing, a particular position obtained by multiplying the threshold Th by the variable N and subtracting the result of the multiplication from the position TP. The controller 2 assigns the reference position RP to a target position for the last cutting processing. Subsequent to step S32, the controller 2 executes moving processing (e.g., step S33). As illustrated in FIG. 8, in the moving processing, the controller 2 determines, based on the number of pulses input to the Z-axis motor 34, whether the pressure value is greater than a pressure threshold (hereinafter, referred to as a threshold ThP) (e.g., step S91). The threshold ThP is an upper limit set to the pressure value to avoid an excessive pressure to be applied to the attaching portion 32. In a case where the pressure value is less than or equal to the threshold ThP, the controller 2 determines that the pressure value is not greater than the threshold ThP (e.g., NO in step S91). Then, the controller 2 determines, based on the signal received from the sensor 41, whether the attaching portion 32 has reached the target position specified for the variable N in step S32 (e.g., step S92). If the controller 2 determines that the attaching portion 32 has not reached the target position (e.g., NO in step S92), the routine returns to step S91. If the controller 2 determines that the attaching portion 32 has reached the target position specified in step S32 (e.g., YES in step S92), the routine proceeds to step S93.

In each of the first, second, and third examples, in a case where the gradient of a line indicating the position of the attaching portion 32 relative to the pressure value changes is represented by a legend E1 in FIG. 10, the controller 2 determines that the pressure value is greater than the threshold ThP (e.g., YES in step S91) before determining that the attaching portion 32 has reached the target position. In such a case, the controller 2 controls the up-down drive mechanism 33 to stop the attaching portion 32 from moving in the third direction (e.g., downward) (e.g., step S93). Subsequent to step S93, the controller 2 obtains a comparison height (e.g., step S94). In the first illustrative embodiment, the comparison height obtained in step S94 may be the height of the attaching portion 32 located when the movement of the attaching portion 32 in the third direction is stopped in step S93. In each of the first, second, and third examples represented by the legend E1 in FIG. 10, the controller 2 stores, in the RAM 73, a position MP as a comparison height of the first cutting processing. Subsequent to step S94, the controller 2 determines whether a value indicating the preceding comparison height (e.g., N-1th cutting processing) is greater than a value indicating the current comparison height (e.g., Nth cutting processing) (e.g., step S95). In a case where the value indicating the preceding comparison height is greater than the value indicating the current comparison height, this refers to that the workpiece 20 has not been cut further in its thickness direction in the Nth cutting processing. In a case where the variable N is equal to 1 (one), the controller 2 assigns, to the preceding comparison height, for example, the position TP obtained in step S31. In this case, the value indicating the position TP that is the preceding comparison height is greater than the value indicating of the position MP that is the current comparison height (e.g., YES in step S95). In such a case, subsequent step S95, the controller 2 determines whether a difference between the preceding comparison height and the current comparison height is greater than a threshold (e.g., step S96). The difference between the preceding comparison height and the current comparison height represents a depth (e.g., a thickness) of a cut to be newly made into the workpiece 20 in the Nth cutting processing. The threshold used in step S96 is specified to detect, as an error, a case where the difference between the preceding comparison height and the current comparison height is unusually smaller than the threshold Th. For example, the threshold used in step S96 is assigned a value of one-tenth to half of the threshold Th. The routine may skip step S96 in a case where the reference position is assigned to the target position. In a case where the difference between the position TP and the position MP is greater than the threshold, the controller 2 determines that the difference between the preceding comparison height and the current comparison height is greater than the threshold (e.g., YES in step S96). In such a case, the moving processing ends and the routine returns to the pressure specification processing for variable M of FIG. 7.

In a case where the value indicating the preceding comparison height is less than or equal to the value indicating the current comparison height obtained in step S94 (e.g., NO in step S95) or in a case where the difference between the preceding comparison height and the current comparison height is less than or equal to the threshold (e.g., NO in step S96), the controller 2 provides notification of an error (e.g., step S97). More specifically, for example, the controller 2 controls the LCD 51 to display thereon an error message indicating such that "Cutting has failed." Subsequent to step S97, the controller 2 discontinues the cutting processing being executed based on the cutting data obtained in step S1 and controls the up-down drive mechanism 33 to move the attaching portion 32 in the fourth direction (e.g., upward) to stop at the raised position (e.g., step S98). In response to the completion of step S98, the main processing ends.

Referring to FIG. 7, in the pressure specification processing for variable M, subsequent to step S33, the controller 2 specifies a stop position SP between the holding position HP obtained in step S4 and the position of the attaching portion 32 in the fifth direction when a distal end of the cutting blade 16 held by the attaching portion 32 reaches the upper surface 26 of the platen 3 (e.g., the platen position PP). The platen position PP is stored in, for example, the flash memory 74. In the first illustrative embodiment, the controller 2 assigns, to the stop position SP, a particular position shifted in the third direction from the holding position HP by a certain distance (e.g., 2.3 mm). Subsequent to step S25, the controller 2 obtains a stiffness of the workpiece 20 (e.g., step S36). The stiffness of the workpiece 20 may be input by the user or determined according to, for example, the type of the workpiece 20. In the first illustrative embodiment, as illustrated in FIG. 10, the controller 2 obtains the stiffness of the workpiece 20 based on the gradient (e.g., a ratio) of the line indicating the height of the attaching portion 32 relative to the pressure value in a period T. The period T refers to a particular period during which the cutting blade 16 penetrates the workpiece 20 in a period from the instant when the controller 2 starts to move the attaching portion 32 in the third direction in step S29 to the instant when the controller 2 stops the attaching portion 32 from moving in the third direction in step S93. More specifically, for example, the controller 2 obtains the stiffness of the workpiece 20 based on a relationship among the ratio of the height of the attaching portion 32 to the pressure value, the ratio of the height of the attaching portion 32 to the pressure value stored in the flash memory 74, and stiffness. Subsequent to step S36, the controller 2 assigns, to a reference pressure value, the pressure value corresponding to the pressure to be applied when the cutting processing is executed, based on the pressure value achieved when the controller 2 stops the attaching portion 32 from moving in the third direction in step S93 (e.g., step S37). In the first illustrative embodiment, the controller 2 assigns, to the reference pressure value, the pressure value achieved when the controller 2 stops the attaching portion 32 from moving in the third direction in step S93.

Subsequent to step S37, the controller 2 specifies a target range ARN and an adjustment range PRN both used in the cutting processing with respect to the variable N (e.g., step S38). The target range ARN defines a range of target positions of the attaching portion 32 in the fifth direction during execution of the cutting processing. The adjustment range PRN is specified according to the target range ARN. In the first illustrative embodiment, the controller 2 specifies the target range ARN based on the height of the attaching portion 32 located when stopping the attaching portion 32 from moving in the third direction in step S93, that is, based on the comparison height obtained in step S94. The adjustment range PRN has a range within which the pressure value is changeable. In processing for changing the pressure value, the pressure value may be changed within the adjustment range PRN to position the attaching portion 32 within the target range ARN in the fifth direction. The adjustment range PRN includes the reference pressure value assigned in step S37. That is, the target range ARN and the adjustment range PRN according to the target range ARN are specified for each time N of cutting processing. More specifically, for example, the controller 2 specifies the target range ARN and the adjustment range PRN for the first cutting processing as described below. The controller 2 assigns, to an upper limit of the target range AR1, a value indicating a particular height obtained by subtracting a certain value (e.g., 0.10 mm) from the comparison height. The controller 2 assigns, to a lower limit of the target range AR1, a value indicating a particular height obtained by subtracting a certain value (e.g., 0.15 mm) from the comparison height. That is, the controller 2 assigns, to the target range AR1, a range whose upper limit is lower than the comparison height. The controller 2 assigns, to a lower limit of the adjustment range PR1, a value obtained by subtracting a certain value (e.g., 24 pulses) from the reference pressure value. The controller 2 assigns, to an upper limit of the adjustment range PR1, a value obtained by adding a certain value (e.g., 4 pulses) to the reference pressure value. A difference between the lower limit of the adjustment range PR1 and the reference pressure value (e.g., 24 pulses) is greater than a difference between the upper limit of the adjustment range PR1 and the reference pressure value (e.g., 4 pulses).

Subsequent to step S38, the controller 2 specifies a decrease amount and an increase amount of the pressure value used in processing for positioning the attaching portion 32 at a particular position within the target range ARN in the fifth direction (e.g., step S39). In a case where the attaching portion 32 is located out of the target range ARN, for example, at a position shifted in the third direction from the target range ARN, the controller 2 changes the pressure value to another value corresponding to pressure lower than the current pressure. More specifically, for example, the controller 2 changes the pressure value to a value obtained by subtracting a decrease amount according to the stiffness obtained in step S36 from the current pressure value. As the workpiece 20 has a higher stiffness, the controller 2 assigns a greater value to the decrease amount. In a case where the attaching portion 32 is located out of the target range ARN, for example, at a position shifted in the fourth direction from the target range ARN, the controller 2 changes the pressure value to another value corresponding to pressure higher than the current pressure. More specifically, for example, the controller 2 changes the pressure value to a value obtained by adding an increase amount according to the stiffness obtained in step S36 to the current pressure value. As the workpiece 20 has a higher stiffness, the controller 2 assigns a greater value to the increase amount. A relationship between the stiffness of the workpiece 20, the decrease amount, and the increase amount is stored in, for example, the flash memory 74. Referring to the flash memory 74, the controller 2 assigns appropriate values to the decrease amount and the increase amount, respectively, according to the stiffness of the workpiece 20 obtained in step S36.

Subsequent to step S39, the controller 2 determines whether the setting position coincides with the cutting start point (e.g., step S40). In the first example, the cutting start point is assigned to the setting position. The controller 2 thus determines that the setting position coincides with the cutting start point (e.g., YES in step S40). In such a case, the pressure specification processing for variable M ends and the routine returns to the main processing of FIG. 6. In the second and third examples, the cutting start point is not assigned to the setting position. The controller 2 thus determines that the setting position does not coincide with the cutting start point (e.g., NO in step S40). In such a case, the controller 2 controls the up-down drive mechanism 33 to move the attaching portion 32 in the fourth direction (e.g., upward) to stop at the raised position (e.g., step S41). Subsequent to step S41, the controller 2 controls the conveying mechanism 7 and the head moving mechanism 8 to respectively move the holding member 10 and the attaching portion 32 relative to each other to position the cutting blade 16 above the cutting start point of the Mth pattern data piece (e.g., step S42). More specifically, in the second example, the controller 2 controls the conveying mechanism 7 and the head moving mechanism 8 to respectively move the attaching portion 32 and the holding member 10 relative to each other to position the cutting blade 16 above the cutting start point P11. In the third example, the controller 2 controls the conveying mechanism 7 and the head moving mechanism 8 to respectively move the attaching portion 32 and the holding member 10 relative to each other to position the cutting blade 16 above the cutting start point P21. Subsequent to step S42, the controller 2 controls the up-down drive mechanism 33 to move the attaching portion 32 in the third direction (e.g., downward) until the attaching portion 32 reaches a particular position at which the pressure corresponding to the pressure value assigned in step S37 is applied to the attaching portion 32 (e.g., step S43). Subsequent to step S43, the pressure specification processing for variable M ends and the routine returns to the main processing of FIG. 6.

Figure 9A:
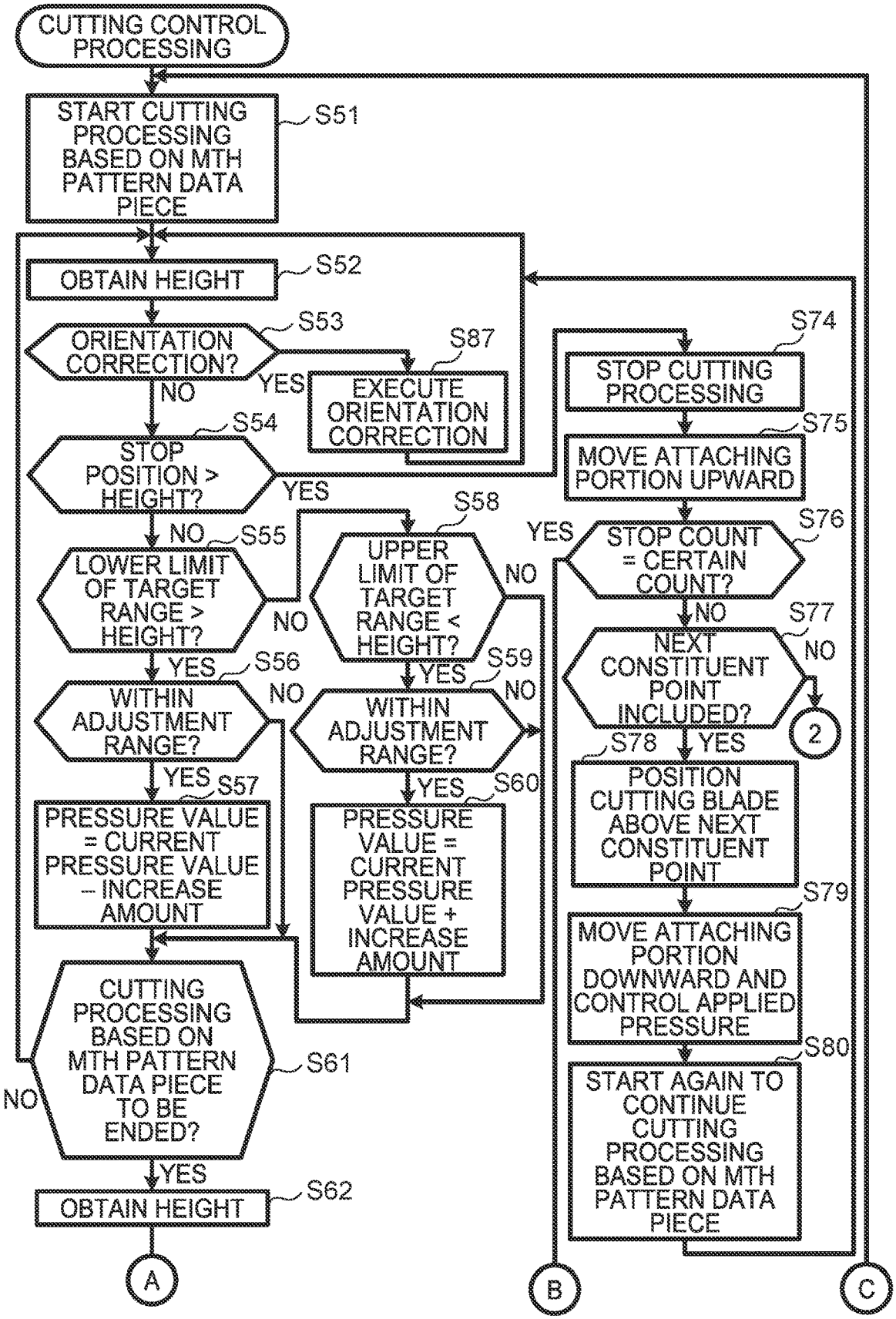
FIG. 9A is a flowchart of cutting control processing executed in the main processing of FIG. 6 according to one or more of the first, second, third illustrative embodiments of the disclosure.
Figure 9B:
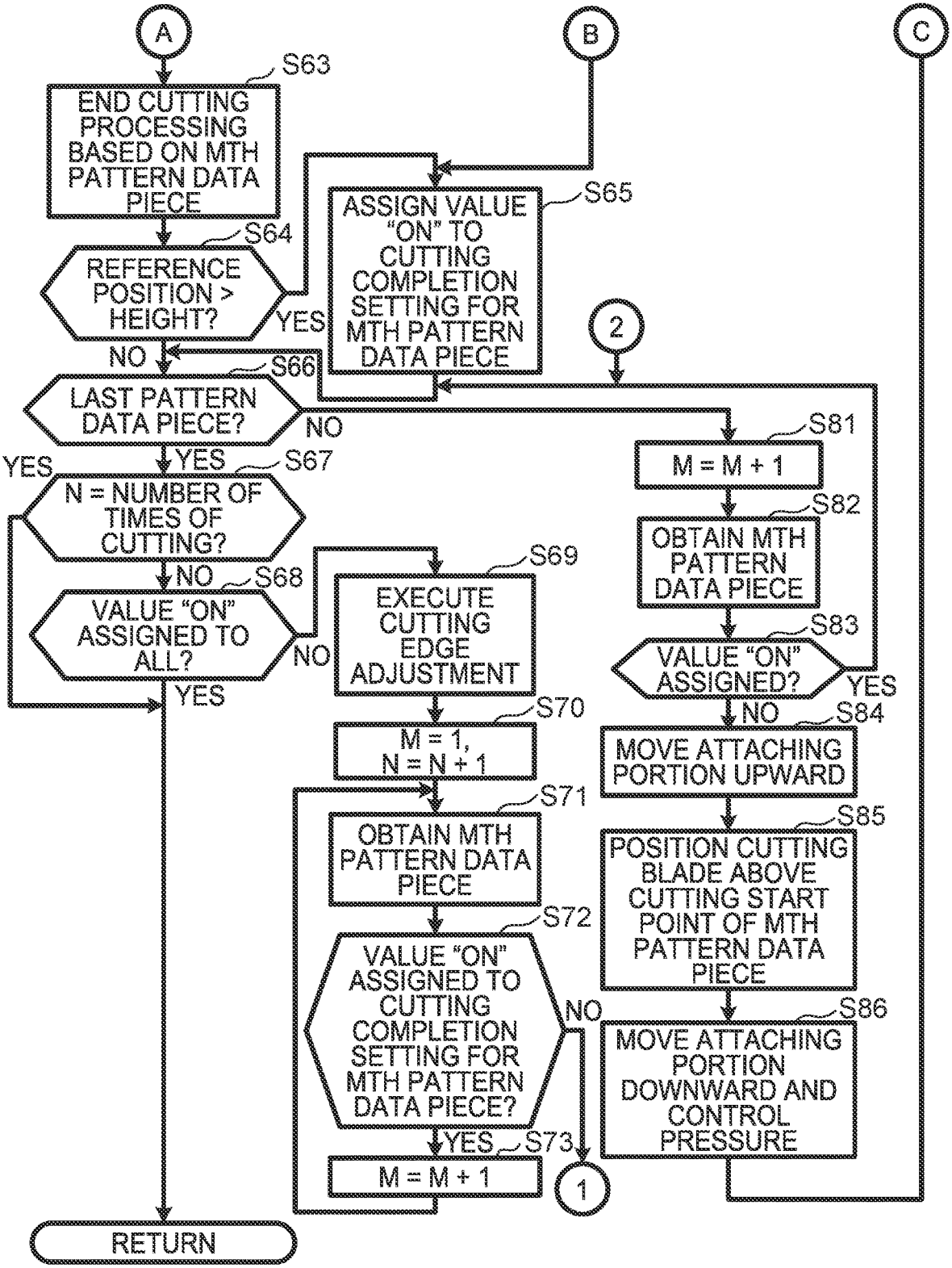
FIG. 9B is a continuation of the flowchart of FIG. 9A according to one or more of the first, second, third illustrative embodiments of the disclosure.

As illustrated in FIG. 6, subsequent to step S9, the controller 2 executes cutting control processing (e.g., step S10). The cutting control processing will be described on, for example, a case where a pattern Z1 is cut in the workpiece 20 in the first example. As illustrated in FIG. 9A, in the cutting control processing, the controller 2 starts cutting processing based on the Mth pattern data piece (e.g., step S51). In the first illustrative embodiment, the controller 2 controls the pressure applied to the attaching portion 32 by maintaining the state of the Z-axis motor 34 that has been stopped. The controller 2 sequentially reads out the coordinate data included in the Mth pattern data piece and controls the conveying mechanism 7 and the head moving mechanism 8 to cut the pattern Z1 in the workpiece 20 using the cutting blade 16. Based on all the read coordinate data included in the Mth pattern data piece, the cutting processing continues on the workpiece 20 until the attaching portion 32 reaches a position corresponding to the last constituent point of the Mth pattern data piece with respect to the workpiece 20.

Figure 11:
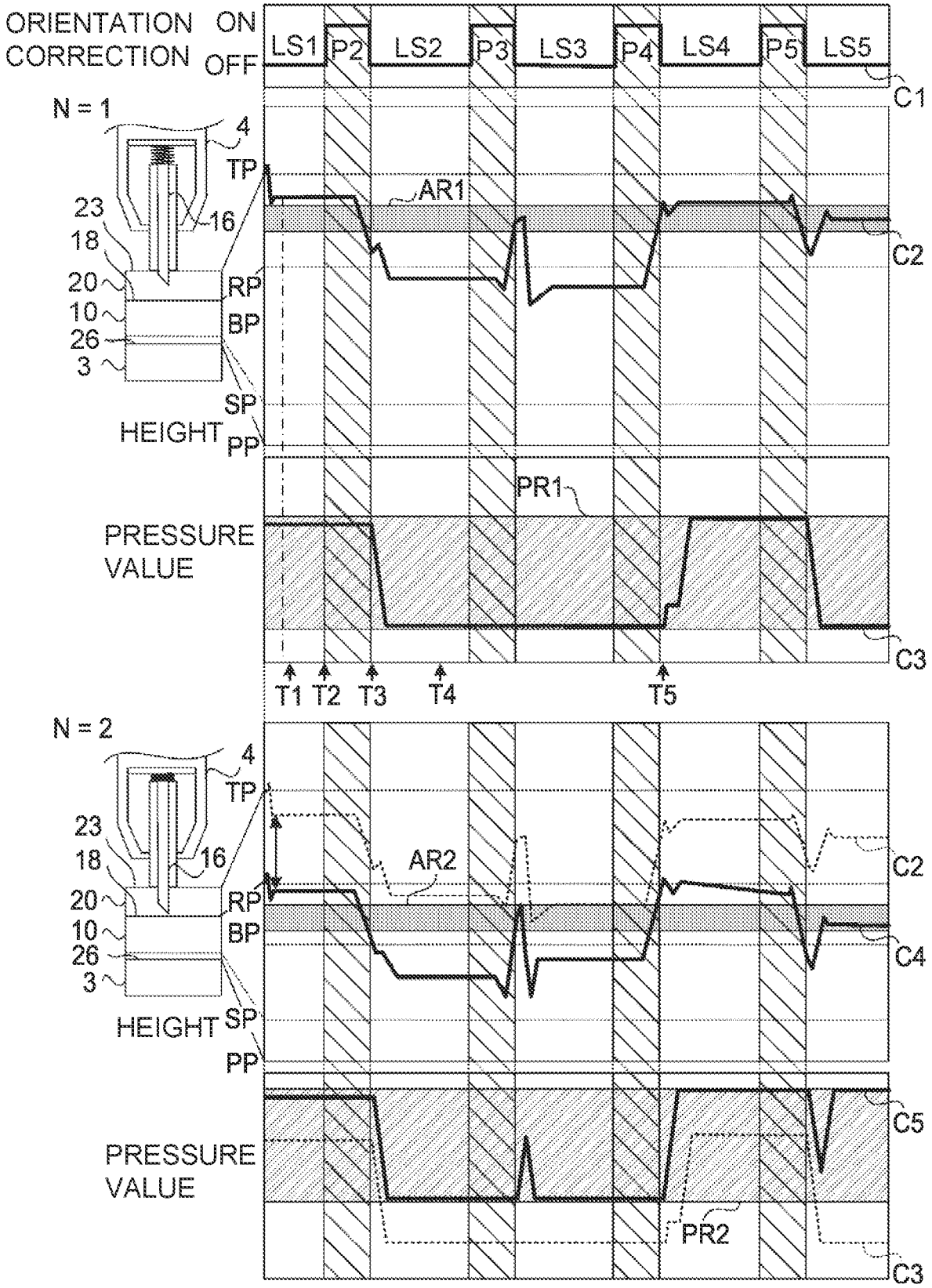
FIG. 11 is a graph showing the presence or absence of execution of an orientation correction in chronological change of the height of the attaching portion and chronological change of the pressure value in a case where a variable N is assigned 1 (one) and in a case where the variable N is assigned 2 in the cutting processing of the first example according to one or more of the first, second, third illustrative embodiments of the disclosure.

Subsequent to step S51, the controller 2 obtains, based on the signal received from the sensor 41 during the cutting processing, the height of the attaching portion 32 (e.g., step S52). Subsequent to step S52, the controller 2 determines whether an orientation correction is to be executed (e.g., step S53). In the line segments constituting the pattern Z1 represented by the Mth pattern data piece, two line segments meeting at a point form smaller and larger angles, respectively, on opposite sides thereof. In a case where an angle measure of the smaller angle is equal to or smaller than a certain angle, the controller 2 executes the orientation correction. In the orientation correction, the controller 2 changes, at a joining point of the two line segments that form the smaller angle having the certain angle or smaller, a direction in which the cutting blade 16 faces. That is, in a case where the position of the attaching portion 32 (more specifically, the cutting blade 16) relative to the workpiece 20 comes coincident with a position corresponding to the joining point of the two line segments that form the smaller angle having the certain angle or smaller, the controller 2 determines that the orientation correction is to be executed. Any suitable value may be assigned to the certain angle. In one example, the certain angle may be 90 degrees. That is, in the first illustrative embodiment, in a case where a smaller angle formed by two line segments meeting at a point is a right angle or an acute angle, the controller 2 executes the orientation correction. In FIG. 11, a legend C1 represents execution or nonexecution of the orientation correction in the cutting processing in the first example. The controller 2 does not execute the orientation correction while the cutting blade 16 cuts respective portions of the pattern Z1 corresponding to the line segments LS1, LS2, LS3, LS4, and LS5 in the workpiece 20 (e.g., "OFF"). The controller 2 executes the orientation correction when the cutting blade 16 is located at each position of the pattern Z1 corresponding to one of the constituent points P2, P3, P4, and P5 (e.g., "ON").

In a case where the cutting blade 16 is cutting a portion of the pattern Z1 corresponding to the line segment LS1 in the workpiece 20 and has not reached a position of the pattern Z1 corresponding to the constituent point P2, the controller 2 determines that the orientation correction is not to be executed (e.g., NO in step S53). In such a case, the controller 2 determines whether the height of the attaching portion 32 obtained in step S52 is lower than the stop position SP assigned in step S35 (e.g., step S54). If the controller 2 determines that the height of the attaching portion 32 obtained in step S52 is lower than the stop position SP (e.g., YES in step S54), the controller 2 stops controlling the conveying mechanism 7 and the head moving mechanism 8 to stop the cutting processing (e.g., step S74). The controller 2 increments a stop count by one. The stop count may refer to the number of times the cutting processing is stopped by execution of step S74 in the cutting processing being executed based on the Mth pattern data piece. The stop count is set to each pattern data piece. An initial value of the stop count may be 0 (zero). Subsequent to step S74, the controller 2 controls the up-down drive mechanism 33 to move the attaching portion 32 in the fourth direction (e.g., upward) to stop at the raised position (e.g., step S75). Subsequent to step S75, the controller 2 determines whether the stop count in the cutting processing being executed based on the Mth pattern data piece is equal to a certain count (e.g., step S76). If the controller 2 determines that the stop count is equal to the certain count (e.g., YES in step S76), the routine proceeds to step S65.

If the controller 2 determines that the stop count is less than the certain count (e.g., NO in step S76), the controller 2 determines whether the Mth pattern data piece includes the next constituent point (e.g., step S77). The next constituent point is an end point of the line segment to be cut subsequent to the line segment being currently cut. In a case where, for example, the cutting blade 16 is cutting a portion of the pattern Z1 corresponding to the line segment LS5, the Mth pattern data piece representing the pattern Z1 includes no more constituent point, that is, the pattern data piece representing the pattern Z1 does not include the next constituent point. Thus, the controller 2 determines that the Mth pattern data piece does not include the next constituent point (e.g., NO in step S77). In such a case, the routine proceeds to step S66. In a case where the cutting blade 16 is cutting a portion of the pattern Z1 corresponding to the line segment LS1, the Mth pattern data piece representing the pattern Z1 includes the next constituent point that may be the end point of the line segment LS2 to be cut subsequent to the line segment LS1. Thus, the controller 2 determines that the Mth pattern data piece includes the next constituent point (e.g., YES in step S77). In such a case, the controller 2 controls the conveying mechanism 7 and the head moving mechanism 8 to respectively move the attaching portion 32 and the holding member 10 relative to each other to position the cutting blade 16 above the constituent point P2 that may be a start point of the line segment LS2 to be cut subsequent to the line segment LS1 (e.g., step S78). Subsequent to step S78, the controller 2 controls the up-down drive mechanism 33 to move the attaching portion 32 in the third direction (e.g., downward) until the attaching portion 32 reaches a particular position at which the pressure corresponding to the pressure value assigned in step S37 is applied to the attaching portion 32 (e.g., step S79). Subsequent to step S79, the controller 2 restarts to continue the cutting processing based on the Mth pattern data piece starting from the constituent point P2 (e.g., step S80) and then the routine returns to step S52.

In a case where the height of the attaching portion 32 obtained in step S52 is higher than or equal to the stop position SP (e.g., NO in step S54) and the height of the attaching portion 32 obtained in step S52 is out of the target range ARN (e.g., NO in step S55), the controller 2 changes the assigned pressure value to another value and executes processing for applying, to the attaching portion, by the pressure changer 32, pressure corresponding to the newly assigned pressure value (e.g., appropriate steps of steps S55 to S60). More specifically, for example, the controller 2 determines whether the value indicating the height of the attaching portion 32 obtained in step S52 is smaller than the lower limit of the target range ARN (e.g., step S55) or determines whether the value indicating the height of the attaching portion 32 obtained in step S52 is greater than the upper limit of the target range ARN (e.g., step S58). In FIG. 11, a legend C2 represents chronological change of the height of the attaching portion 32 in a case where the variable N is assigned 1 (one) and a legend C3 represents chronological change of the pressure value in a case where the variable N is assigned 1 (one). A legend C4 represents chronological change of the height of the attaching portion 32 in a case where the variable N is assigned 2, and a legend C5 represents chronological change of the pressure value in a case where the variable N is assigned 2. As illustrated in FIG. 11, the value indicating the height of the attaching portion 32 obtained at timing T1 is greater than an upper limit of a target range AR1 (e.g., NO in step S55 and YES in step S58). In such a case, the controller 2 determines whether a value obtained by adding the increase amount assigned in step S39 to the current pressure value is within an adjustment range PR1 assigned in step S38 (e.g., step S59). In a case where the increase amount is added to the pressure value at timing T1, the pressure value is out of the adjustment range PR1 (e.g., NO in step S59). In such a case, the controller 2 does not change the current pressure value and determines whether the cutting processing based on the Mth pattern data piece is to be ended (e.g., step S61). At timing T1, the position of the attaching portion 32 (more specifically, the cutting blade 16) relative to the workpiece 20 does not coincide with a position corresponding to the constituent point P6 that may be a cutting end point of the pattern Z1. Thus, the controller 2 determines that the cutting processing based on the Mth pattern data piece is not to be ended (e.g., NO in step S61) and the routine returns to step S52.

As illustrated in FIG. 11, at timing T2, where the position of the attaching portion 32 (more specifically, the cutting blade 16) relative to the workpiece 20 coincides with a position corresponding to the constituent point P2. Thus, the controller 2 determines that the orientation correction is to be executed (e.g., YES in step S53), thereby executing the orientation correction (e.g., step S87). The orientation correction may be executed appropriately in accordance with a known procedure. For example, as illustrated in the row C of FIG. 5, the controller 2 moves the attaching portion 32 and the holding member 10 relative to each other so that a rotation axis of the cutting blade 16 moves relative to the workpiece 20 from the constituent point P2 to a particular position above a point P8 that is on an extension line of the line segment LS1. The controller 2 then moves the attaching portion 32 and the holding member 10 relative to each other so that the rotation axis of the cutting blade 16 arcs relative to the workpiece 20 from the particular position above the point P8 to a further particular position above a point P9 that is on the line segment LS2, thereby allowing the cutting edge of the cutting blade 16 to face to a direction in which the line segment LS2 corresponding to a portion of the pattern Z1 to be cut next extends. The orientation correction may be executed appropriately in accordance with another known procedure. For example, the controller 2 controls the up-down drive mechanism 33 to decrease the pressure being applied to the attaching portion 32 to position the distal end of the cutting blade 16 on or adjacent to the front surface 23 of the workpiece 20. Then, the controller 2 rotates the cutting blade 16 in the attaching portion 32 to allow the cutting edge of the cutting blade 16 to face to the direction in which the line segment LS2 corresponding to a portion of the pattern Z1 to be cut next extends. Subsequent to step S87, the routine returns to step S52.

In a case where the controller 2 obtains the height of the attaching portion 32 at timing T3 (refer to FIG. 11), the controller 2 determines that the value indicating the height of the attaching portion 32 is smaller than the lower limit of the target range AR1 (e.g., YES in step S55). In such a case, the controller 2 determines whether a value obtained by subtracting the decrease amount assigned in step S39 from the current pressure value is within the adjustment range PR1 assigned in step S38 (e.g., step S56). The controller 2 determines that the value obtained by subtracting the increase amount assigned in step S39 from the pressure value achieved at timing T3 is within the adjustment range PR1 (e.g., YES in step S56) and changes the pressure value to another value obtained by subtracting, from the current pressure value, a particular reduction amount according to the stiffness obtained in step S36. The controller 2 then controls the up-down drive mechanism 33 based on the newly assigned pressure value (e.g., step S57) and the routine returns to step S52 (e.g., NO in step S61).

In a case where the controller 2 obtains the height of the attaching portion 32 at timing T4 (refer to FIG. 11), the controller 2 determines that the value indicating the height of the attaching portion 32 is smaller than the lower limit of the target range AR1 (e.g., YES in step S55) and determines that a value obtained by subtracting a particular decrease amount assigned in step S39 from the current pressure value is out of the adjustment range PR1 (e.g., NO in step S56). Subsequent to step S56, the routine returns to step S52 (e.g., NO in step S61).

In a case where the controller 2 obtains the height of the attaching portion 32 at timing T5 (refer to FIG. 11), the controller 2 determines that the value indicating the height of the attaching portion 32 is greater than the upper limit of the target range AR1 (e.g., NO in step S55 and YES in step S58) and determines that a value obtained by adding a particular increase amount assigned in step S39 to the pressure value achieved at timing T4 is within the adjustment range PR1 (e.g., YES in step S59). In this case, the controller 2 changes the pressure value to another value obtained by adding, to the current pressure value, an increase amount according to the stiffness obtained in step S36 and controls the up-down drive mechanism 33 based on the newly assigned pressure value (e.g., step S60). Subsequent to step S60, the routine returns to step S52 (e.g., NO in stet S61).

In a case where the attaching portion 32 has reached, relative to the workpiece 20, a position corresponding to the cutting end point P6 of the pattern Z1, the controller 2 determines that the cutting processing based on the Mth pattern data piece (e.g., the first pattern data piece) is to be ended (e.g., YES in step S61). In such a case, the controller 2 obtains, based on the signal received from the sensor 41, the height of the attaching portion 32 located at the position corresponding to the cutting end point P6 (e.g., step S62). Subsequent to step S62, the controller 2 stops controlling the conveying mechanism 7 and the head moving mechanism 8 to end the cutting processing based on the Mth pattern data piece (e.g., step S63). Subsequent to step S63, the controller 2 determines whether the height of the attaching portion 32 obtained in step S62 is lower than the reference position RP assigned in step S5 (e.g., step S64). If the controller 2 determines that the height of the attaching portion 32 obtained in step S62 is lower than the reference position RP (e.g., YES in step S64), the controller 2 assigns a value "ON" to a cutting completion setting for the Mth pattern data piece (e.g., step S65). An appropriate value is assigned to the cutting completion setting for each pattern data piece included in the cutting data obtained in step S1. An initial value of the cutting completion setting may be "OFF".

In a case where the height of the attaching portion 32 obtained in step S62 is higher than or equal to the reference position RP (e.g., NO in step S64) or subsequent to step S65, the controller 2 determines whether the Mth pattern data piece is the last one in the cutting order among the one or more pattern data pieces included in the cutting data obtained in step S1 (e.g., step S66). In the first example, the Mth pattern data piece is the first pattern data piece. Thus, the controller 2 determines that the Mth pattern data piece is not the last pattern data piece in the cutting order (e.g., NO in step S66). In such a case, the controller 2 increments the value of the valuable M by one (e.g., step S81) and obtains the Mth pattern data piece (e.g., step S82). Subsequent to step S82, the controller 2 determines whether the value "ON" is assigned to the cutting completion setting for the Mth pattern data piece (e.g., step S83). If the controller 2 determines that the value "ON" is assigned to the cutting completion setting for the Mth pattern data piece (e.g., YES in step S83), the routine returns to step S66. In the first example, the Mth pattern data piece obtained in step S82 is the second pattern data piece in the cutting order. Thus, the controller 2 determines that the value "ON" is not assigned to the cutting completion setting for the Mth pattern data piece (e.g., NO in step S83). In such a case, the controller 2 controls the up-down drive mechanism 33 to move the attaching portion 32 in the fourth direction (e.g., upward) to stop at the raised position (e.g., step S84). Subsequent to step S84, the controller 2 controls the conveying mechanism 7 and the head moving mechanism 8 to respectively move the holding member 10 and the attaching portion 32 relative to each other to position the cutting blade 16 above a cutting start point of the Mth (e.g., the second) pattern data piece obtained in step S82 (e.g., step S85). Subsequent to step S85, the controller 2 controls the up-down drive mechanism 33 to move the attaching portion 32 in the third direction (e.g., downward) until the attaching portion 32 reaches a particular position at which the pressure corresponding to the pressure value assigned in step S37 is applied to the attaching portion 32 (e.g., step S86) and then the routine returns to step S51. Thereafter, in the first example, the second pattern Z1 and the third pattern Z2 are cut in the workpiece 20 in this order by the above described procedure.

In the first example, in a case where the cutting control processing is executed on the third pattern data piece, the controller 2 determines, in step S66, that the Mth pattern data piece is the last one in the cutting order among the one or more pattern data pieces included in the cutting data obtained in step S1 (e.g., YES in step S66). In such a case, the controller 2 determines whether the value of the variable N is equal to the number of times of cutting obtained in step S31 (e.g., step S67). If, in the first example, the value of the variable N is assigned 1 (one), the controller 2 determines that the value of the variable N is not equal to the number of times of cutting obtained in step S31 (e.g., NO in step S67). In such a case, the controller 2 determines whether the value "ON" is assigned to the cutting completion setting for all of the one or more pattern data pieces included in the cutting data obtained in step S1 (e.g., step S68). In a case where the value "OFF" is assigned to the cutting completion setting for at least one of the one or more pattern data pieces included in the cutting data obtained in step S1 (e.g., NO in step S68), the controller 2 executes a cutting edge adjustment (e.g., step S69). More specifically, for example, in the cutting edge adjustment, the controller 2 controls the up-down drive mechanism 33 to move the attaching portion 32 in the fourth direction (e.g., upward) and then executes the same or similar processing to steps S2, S3, S6, and S7. Subsequent to step S69, the controller 2 assigns 1 (one) to the value of the variable M and increments the value of the valuable N by one (e.g., step S70). Subsequent to step S70, the controller 2 obtains the Mth pattern data piece (e.g., step S71). Subsequent to step S71, the controller 2 determines whether the value "ON" is assigned to the cutting completion setting for the Mth pattern data piece (e.g., step S72). If the controller 2 determines that the value "ON" is assigned to the cutting completion setting for the Mth pattern data piece (e.g., YES in step S72), the controller 2 increments the value of the valuable M by one and the routine returns to step S71. In the first example, the value "OFF" is assigned to the cutting completion setting for the first pattern data piece (e.g., NO in step S72). In such a case, the routine proceeds to step S9 in FIG. 6. The controller 2 executes the pressure specification processing for variable M in the second cutting processing (e.g., step S9).

In a case where the gradient of a line indicating the height of the attaching portion 32 relative to the pressure value change where the variable N is assigned 2 is represented by a legend E2 in FIG. 10, the controller 2 determines, in step S95 of FIG. 8, that a position LP is lower than the position MP (e.g., YES in step S95), and in step S96, that a difference D between the preceding comparison height and the current comparison height is greater than the threshold (refer to FIG. 11) (e.g., YES in step S96). The position LP may be the current comparison height. The position MP may be the preceding comparison height. In step S38 of FIG. 7, the controller 2 specifies a target range AR2 and an adjustment range PR2. The target range AR2 defines the upper and lower limits for the height of the attaching portion 32 lower than those defined by the target range AR1. The adjustment range PR2 defines the upper and lower limits for the pressure value greater than those defined by the adjustment range PR1. In step S67 of FIG. 9B, the controller 2 determines that the value of the variable N is equal to the number of times of cutting obtained in step S31 (e.g., YES in step S67). In a case where the value of the variable N is equal to the number of times of cutting obtained in step S31 (e.g., YES in step S67) or in a case where the value "ON" is assigned to the cutting completion setting for all of the one or more pattern data pieces included in the cutting data obtained in step S1 (e.g., YES in step S68), the cutting control processing ends and the routine returns to the main processing of FIG. 6. In each of the second and third examples, the controller 2 executes the cutting control processing in a similar manner to the first example. As illustrated in FIG. 6, subsequent to step S10, the controller 2 controls the up-down drive mechanism 33 to move the attaching portion 32 in the fourth direction (e.g., upward) to stop at the raised position (e.g., step S11). In response to the completion of step S11, the main processing ends.

Figure 12:
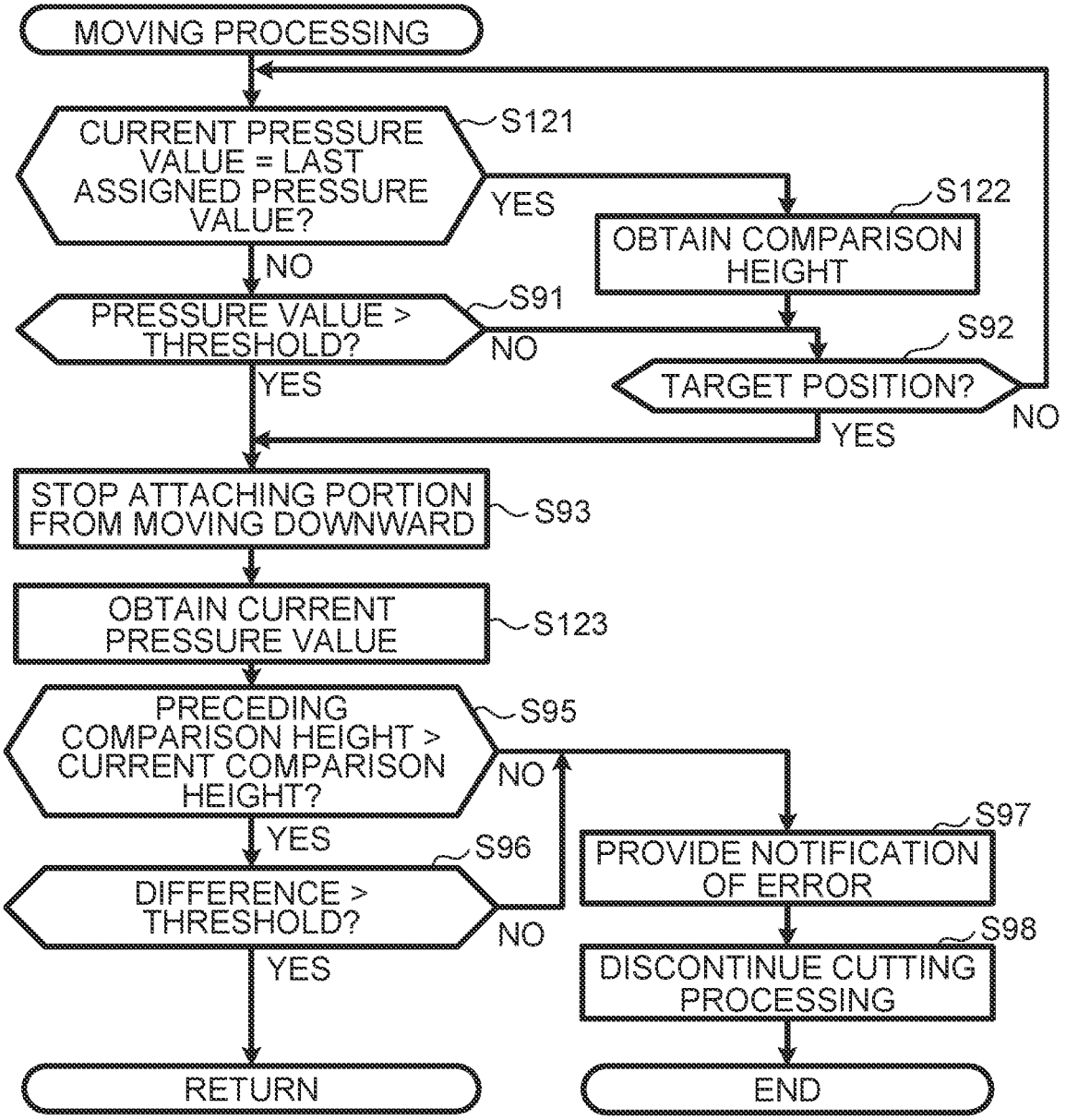
FIG. 12 is a flowchart of moving processing according to the second illustrative embodiment of the disclosure.

Hereinafter, a description will be provided on main processing according to the second illustrative embodiment. The main processing according to the second illustrative embodiment includes the same steps as the main processing according to the first illustrative embodiment except that the moving processing of FIG. 12 includes steps different from the steps included in the moving processing of FIG. 8 according to the first illustrative embodiment. In the main processing according to the second illustrative embodiment, in step S33 of FIG. 7, the controller 2 executes the moving processing of FIG. 12. In FIG. 12, common steps have the same step numbers as those of the first illustrative embodiment. The moving processing according to the second illustrative embodiment further includes steps S121, S122, and S123 and skips step S94, which are different from the moving process according to the first illustrative embodiment. Hereinafter, steps S121, S122, and S123 that are not included in the moving processing of the first illustrative embodiment will be described, and a description for the steps similar to the steps included in the moving processing of the first illustrative embodiment will be omitted.

As illustrated in FIG. 12, the controller 2 determines whether the current pressure value is equal to the pressure value assigned in step S37 executed last time (e.g., the last assigned pressure value) (e.g., step S121). If the controller 2 determines that the current pressure value is not equal to the last assigned pressure value (e.g., NO in step S121), the routine proceeds to step S91. If the controller 2 determines that the current pressure value is equal to the last assigned pressure value (e.g., YES in step S121), the controller 2 obtains, as the comparison height, the position of the attaching portion 32 in the fifth direction when the pressure value corresponding to the pressure applied to the attaching portion 32 reaches the last assigned pressure value (e.g., step S122) and then the routine proceeds to step S92. If the controller 2 determines that the attaching portion 32 has not reached the target position (e.g., NO in step S92), the routine returns to step S121. Subsequent to step S93, the controller 2 obtains, as the current pressure value, the pressure value achieved when the controller 2 stops the attaching portion 32 from moving in the third direction in step S93 and stores the obtained value in the RAM 73 (e.g., step S123).

Subsequent to step S123, the controller 2 determines whether the value indicating the preceding comparison height obtained in step S122 is greater than the value indicating the current comparison height (e.g., step S95). In a case where a relationship between the height of the attaching portion 32 and the pressure value in the preceding cutting processing is represented by the legend E1 in FIG. 10 and a relationship between the height of the attaching portion 32 and the pressure value in the current cutting processing is represented by the legend E2 in FIG. 10, the value indicating the current comparison height relative to the preceding pressure value ThP is smaller than the value indicating the preceding comparison height the preceding pressure value ThP (e.g., YES in step S95). In such a case, subsequent to step S95, the controller 2 determines whether a difference between the current comparison height obtained in step S122 and the preceding comparison height is greater than the threshold (e.g., step S96). In each of the cases represented by the legends E1 and E2, respectively, the controller 2 determines that the difference between the current comparison height at the preceding pressure value ThP and the preceding comparison height is greater than the threshold (e.g., YES in step S96). In such a case, the moving processing ends. In a case where the relationship between the height of the attaching portion 32 and the pressure value in the preceding cutting processing is represented by the legend E1 in FIG. 10 and the relationship between the height of the attaching portion 32 and the pressure value in the current cutting processing is represented by the legend E3 in FIG. 10, the value indicating the current comparison height relative to the preceding pressure value ThP is greater than or equal to the value indicating the preceding comparison height relative to the preceding pressure value ThP (e.g., NO in step S95). In such a case, the controller 2 provides notification an error (e.g., step S97) and executes discontinuation processing (e.g., step S98). In the second illustrative embodiment, in a case where the current pressure value is smaller than the last assigned pressure value, the controller 2 does not obtain a comparison height. Thus, in a case where the current pressure value is smaller than the last assigned pressure value, the controller 2 may skip steps S95 to S98.

Figure 13A:
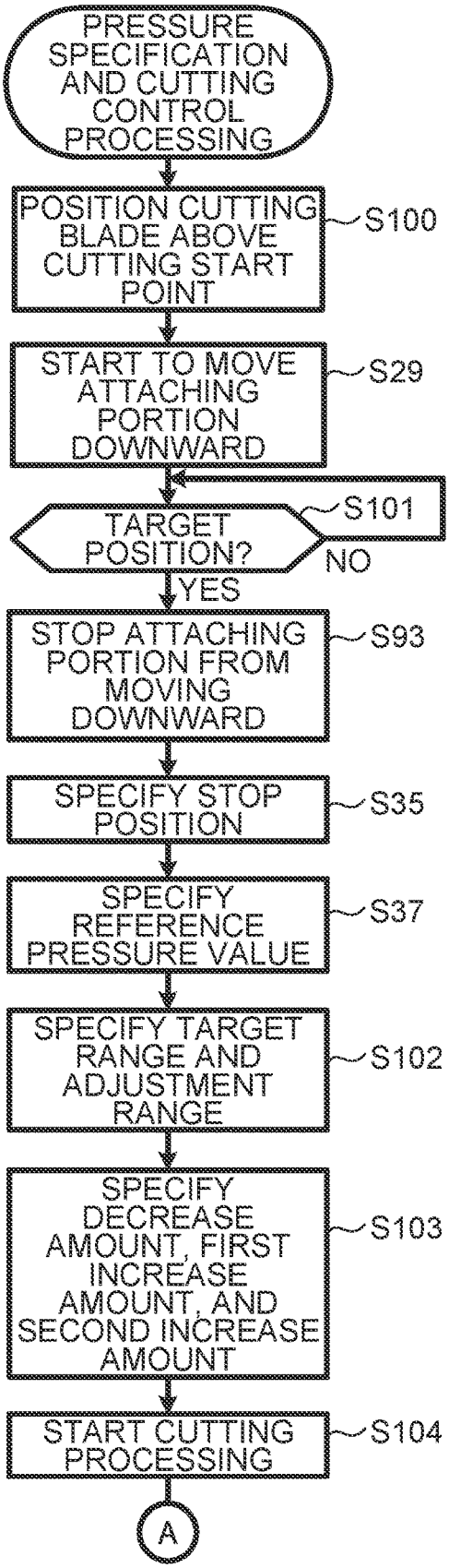
FIG. 13A is a flowchart of pressure specification and cutting control processing according to the third illustrative embodiment of the disclosure.
Figure 13B:
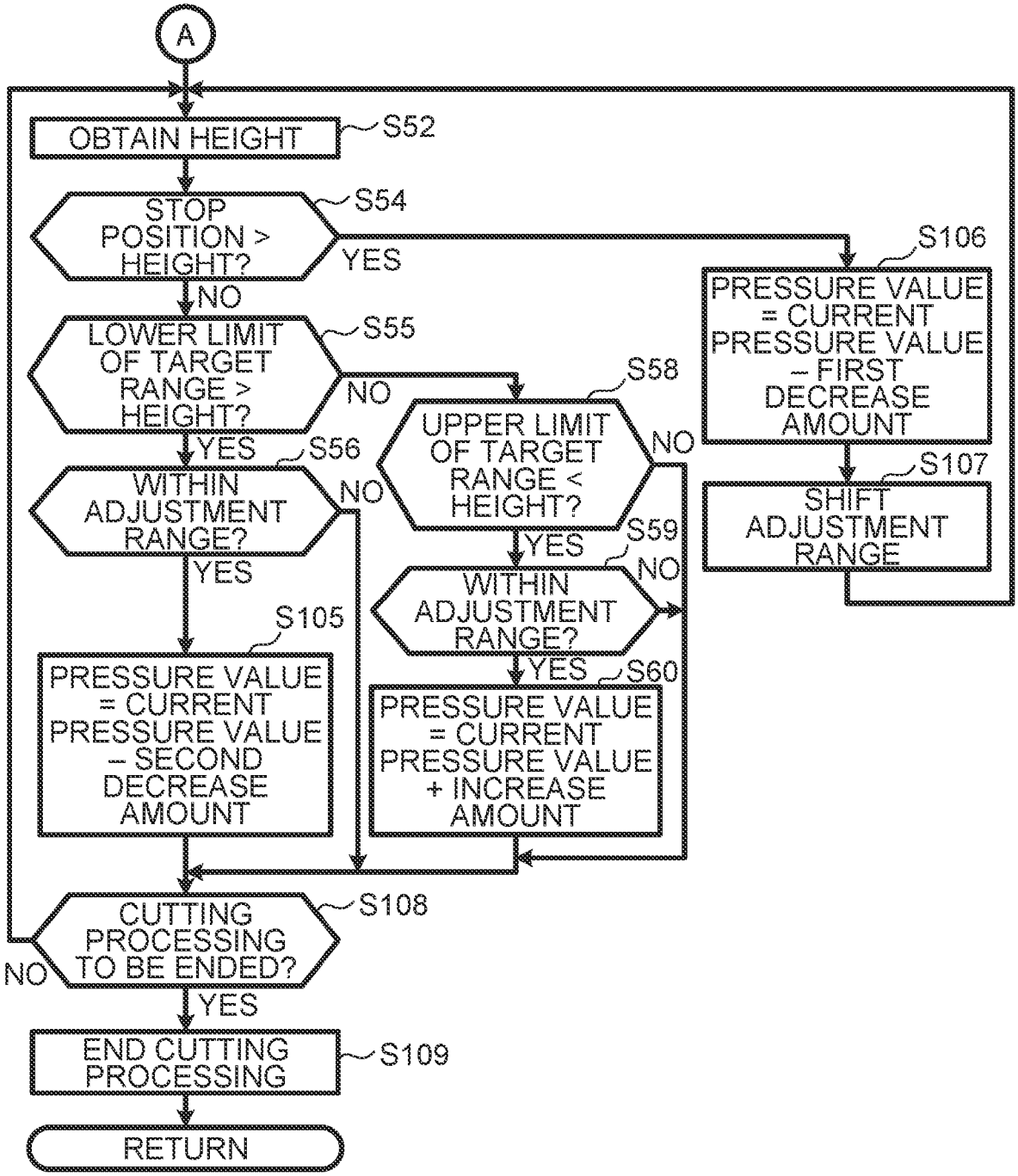
FIG. 13B is a continuation of the flowchart of FIG. 13A according to the third illustrative embodiment of the disclosure.

Hereinafter, a description will be provided on main processing according to the third illustrative embodiment. For example, in a case where cutting is performed on a workpiece 82 having a releasable sheet 81 to be used for creating, for example, a sticker or a label, without using the holding member 10, the main processing of the third illustrative embodiment is executed. The workpiece 82 has a thickness less than the threshold ThL used in the first and second illustrative embodiments. Thus, the cutting apparatus 1 cuts the workpiece 82 fully in the fifth direction by one-time execution of the cutting processing. The main processing according to the third illustrative embodiment includes the same steps as the main processing according to the first illustrative embodiment except that the main processing according to the third illustrative embodiment includes pressure specification and cutting control processing of FIGS. 13A and 13B instead of steps S9 and S10 of FIG. 6. In FIGS. 13A and 13B, common steps have the same step numbers as those of the first illustrative embodiment. Hereinafter, the pressure specification and cutting control processing that is not included in the main processing of the first illustrative embodiment will be described, and description for the steps similar to the steps included in the main processing of the first illustrative embodiment will be omitted. The main processing according to the third illustrative embodiment starts in response to the controller 2 receiving a start instruction after receiving information specifying the type of the workpiece 82 through a user input.

As illustrated in FIG. 13A, in the pressure specification and cutting control processing, the controller 2 controls the conveying mechanism 7 and the head moving mechanism 8 to respectively move the attaching portion 32 and the workpiece 82 relative to each other to position the cutting blade 16 above a cutting start point of an Mth pattern data piece included in the cutting data obtained in step S1 (e.g., step S100) and starts to move the attaching portion 32 in the third direction (e.g., downward) by controlling the up-down drive mechanism 33 (e.g., step S29). Subsequent to step S29, the controller 2 determines, based on the signal received from the sensor 41, whether the attaching portion 32 has reached the target position AP (e.g., step S101). The target position AP refers to the position of the attaching portion 32 that is located when the distal end of the cutting blade 16 is in contact with an upper surface 83 of the releasable sheet 81. For example, the controller 2 determines, based on the position at which the gradient of the line indicating the height of the attaching portion 32 relative to the pressure value changes, whether the attaching portion 32 has reached the target position AP. If the controller 2 determines that the attaching portion 32 has not reached the target position AP (e.g., NO in step S101), the routine returns to step S101. If the controller 2 determines that the attaching portion 32 has reached the target position AP (e.g., YES in step S101), the controller 2 controls the up-down drive mechanism 33 to stop the attaching portion 32 from moving in the third direction (e.g., downward) (e.g., step S93). Subsequent to step S93, the controller 2 specifies a stop position SP (e.g., step S35). In the third illustrative embodiment, the controller 2 assigns, to the stop position SP, a particular position obtained by adding a certain height to the platen position PP. The certain height may be less than a thickness of the releasable sheet 81 and greater than a one-tenth of the thickness of the releasable sheet 81. For example, the certain height may be 0.1 mm.

In the third illustrative embodiment, the controller 2 assigns, to the reference pressure value, the pressure value achieved when the controller 2 stops the attaching portion 32 from moving in the third direction in step S93 (e.g., step S37). Subsequent to step S37, the controller 2 specifies, based on the target position, a target range AR and an adjustment range PR according to the target range AR (e.g., step S102). More specifically, for example, the controller 2 assigns, to an upper limit of the target range AR, the position of the upper surface 83 of the releasable sheet 81. The controller 2 assigns, to a lower limit of the target range AR, a particular position CP obtained by dividing a distance between the stop position SP assigned in step S35 and the target position AP by 2 and subtracting the result of the division from the target position AP. The position CP is located between the target position AP and the stop position SP. The controller 2 assigns, to an upper limit of the adjustment range PR, a value obtained by adding a certain value (e.g., 4 pulses) to the reference pressure value assigned in step S37. The controller 2 assigns, to a lower limit of the adjustment range PR, a value obtained by subtracting a certain value (e.g., 4 pulses) from the reference pressure value assigned in step S37. A difference between the upper limit and the lower limit of the adjustment range PR (e.g., 8 pulses) is smaller than a difference between the upper limit and the lower limit of the adjustment range PR according to the first illustrative embodiment (e.g., 28 pulses). Subsequent to step S102, the controller 2 specifies a first decrease amount, a second decrease amount, and an increase amount (e.g., step S103). The second decrease amount is less than the first decrease amount. The first decrease amount may be, for example, 3 pulses. The second decrease amount may be, for example, 1 pulse. In the third illustrative embodiment, the increase amount and the second decrease amount may be equal to each other.

Figure 14:
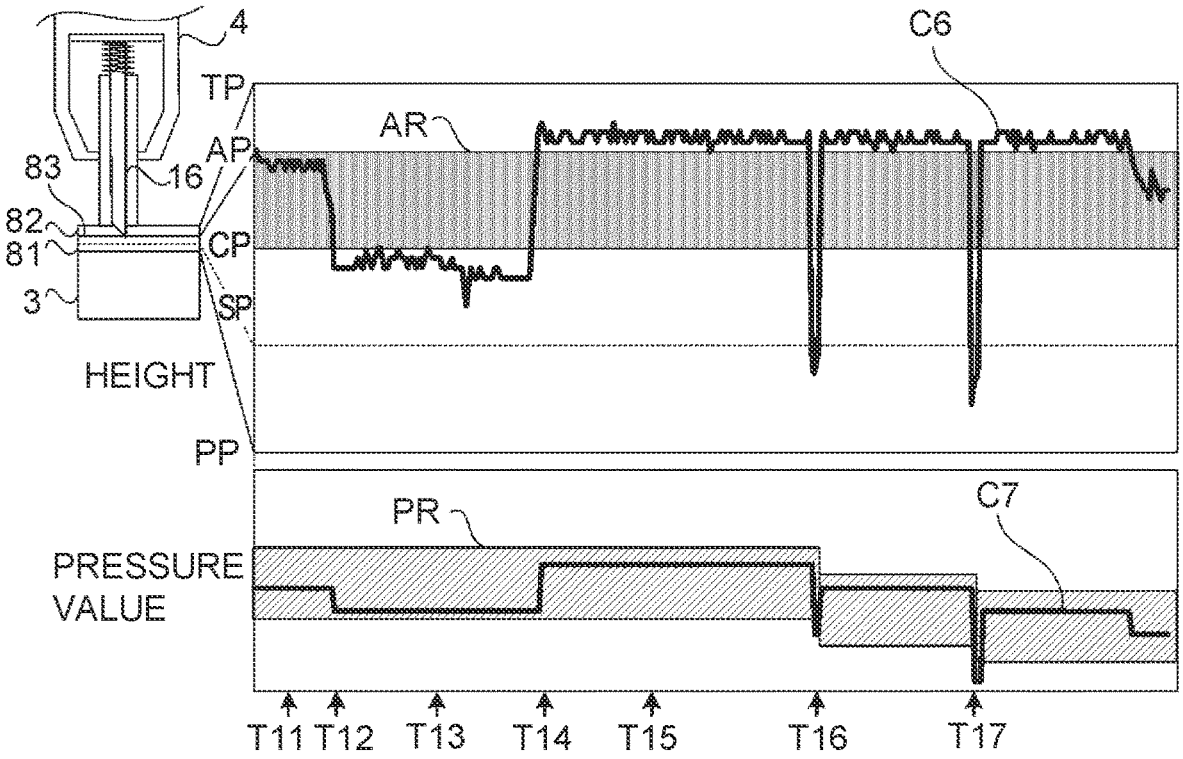
FIG. 14 is a graph showing chronological change of the height of the attaching portion and chronological change of the pressure value according to one or more of the first, second, third illustrative embodiments of the disclosure.

Subsequent to step S103, the controller 2 starts the cutting processing by controlling the conveying mechanism 7 and the head moving mechanism 8 to respectively move the workpiece 82 and the attaching portion 32 relative to each other based on the cutting data obtained in step S1 (e.g., step S104). Subsequent to step S104, the controller 2 obtains, based on the signal received from the sensor 41, the height of the attaching portion 32 (e.g., step S52). In FIG. 14, a legend C6 represents chronological change of the height of the attaching portion 32 and a legend C7 represents chronological change of the pressure value. In a case where the controller 2 obtains the height of the attaching portion 32 at timing T11 (e.g., step S52), the current height of the attaching portion 32 is higher than the stop position SP (e.g., NO in step S54) and is within the target range AR (e.g., NO in step S55 and NO in step S58). In a case where the position of the attaching portion 32 (more specifically, the cutting blade 16) relative to the workpiece 82 does not coincide with a position corresponding to a cutting end point and thus the controller 2 determines that the cutting processing is not to be ended (e.g., NO in step S108), the routine returns to step S52.

In a case where the controller 2 obtains the height of the attaching portion 32 at timing T12 (e.g., step S52), the controller 2 determines that the current height of the attaching portion 32 is higher than the stop position SP (e.g., NO in step S54) and that the value indicating the current height of the attaching portion 32 is smaller than the lower limit of the target range AR (e.g., YES in step S55). In such a case, the controller 2 determines that a value obtained by subtracting the second decrease amount assigned in step S103 from the pressure value at timing T12 is within the adjustment range PR (e.g., YES in step S56). Subsequent to step S56, the controller 2 changes the pressure value to another value obtained by subtracting the second decrease amount from the current pressure value and controls the up-down drive mechanism 33 based on the newly assigned pressure value (e.g., step S105). Subsequent to step S105, the routine returns to step S52 (e.g., NO in stet S108). In a case where the controller 2 obtains the height of the attaching portion 32 at timing T13 (e.g., step S52), the controller 2 determines that the current height of the attaching portion 32 is higher than the stop position SP (e.g., NO in step S54) and that the value indicating the current height of the attaching portion 32 is smaller than the lower limit of the target range AR (e.g., YES in step S55). In such a case, the controller 2 determines that a value obtained by subtracting the second decrease amount assigned in step S103 from the pressure value at timing T13 is out of the adjustment range PR (e.g., NO in step S56) and the routine returns to step S52 (e.g., NO in step S108).

In a case where the controller 2 obtains the height of the attaching portion 32 at timing T14 (e.g., step S52), the controller 2 determines that the current height of the attaching portion 32 is higher than the stop position SP (e.g., NO in step S54) and that the value indicating the current height of the attaching portion 32 is greater than the upper limit of the target range AR (e.g., NO in step S55 and YES in step S58). In such a case, the controller 2 determines that a value obtained by adding the increase amount assigned in step S103 to the pressure value at timing T14 is within the adjustment range PR (e.g., YES in step S59). Subsequent to step S59, the controller 2 changes the pressure value to another value obtained by adding the increase amount to the current pressure value and controls the up-down drive mechanism 33 based on the newly assigned pressure value (e.g., step S60). Subsequent to step S60, the routine returns to step S52 (e.g., NO in stet S108). In a case where the controller 2 obtains the height of the attaching portion 32 at timing T15 (e.g., step S52), the controller 2 determines that the current height of the attaching portion 32 is higher than the stop position SP (e.g., NO in step S54) and that the value indicating the current height of the attaching portion 32 is greater than the upper limit of the target range AR (e.g., NO in step S55 and YES in step S58). In such a case, the controller 2 determines that a value obtained by adding the increase amount assigned in step S103 to the pressure value at timing T15 is out of the adjustment range PR (e.g., NO in step S59) and the routine returns to step S52 (e.g., NO in step S108).

In a case where the controller 2 obtains the height of the attaching portion 32 at timing T16 (e.g., step S52), the controller 2 determines that the current height of the attaching portion 32 is lower than the stop position SP (e.g., YES in step S54). Subsequent to step S54, the controller 2 assigns, to the pressure value, another value obtained by subtracting the first decrease mount from the current pressure value (e.g. in step S106). Subsequent to step S106, the controller 2 shifts the adjustment range PR (e.g., step S107). More specifically, for example, the controller 2 shifts the current adjustment range PR in the third direction by the second decrease amount. Subsequent to step S107, the routine returns to step S52. In a case where the attaching portion 32 has reached, relative to the workpiece 82, a position corresponding to the cutting end point and thus the controller 2 determines that the cutting processing based on the cutting data is to be ended (e.g., YES in step S108), the controller 2 stops controlling the conveying mechanism 7 and the head moving mechanism 8 to end the cutting processing based on the cutting data obtained in step S1 (e.g., step S109). Thus, the pressure specification and cutting control processing ends and the routine returns to the main processing of FIG. 6. In a case where the controller 2 obtains the height of the attaching portion 32 at timing T17 (e.g., step S52), the controller 2 executes the same processing as the case where controller 2 obtains the height of the attaching portion 32 at timing T16.

In the cutting apparatus 1 according to the first, second and third illustrative embodiments, the controller 2 obtains the position of the attaching portion 32 in the fifth direction during execution of the cutting processing. In a case where the obtained position of the attaching portion 32 is out of the target range ARN, the pressure changer 31 changes the pressure applied to the attaching portion 32. Thus, as compared with a case where a constant pressure is applied to the attaching portion 32 by the pressure changer 31 during execution of the cutting processing irrespective of the position of the attaching portion 32 in the fifth direction during executing of the cutting processing, in the cutting apparatus 1, the position of the cutting edge of the cutting blade 16 relative to a workpiece may be adjusted appropriately.

According to the first, second, and third illustrative embodiments, in a case where the position of the attaching portion 32 in the fifth direction obtained in step S52 is shifted in the third direction from the target range ARN (e.g., YES in step S55), the controller 2 of the cutting apparatus 1 changes the pressure value to another value corresponding to the pressure lower than the current pressure (e.g., step S57). In a case where the position of the attaching portion 32 in the fifth direction is shifted in the third direction from the target range ARN, the controller 2 changes the pressure value to another value corresponding to the pressure lower than the current pressure. This may thus reduce likelihood that the position of the attaching portion 32 in the fifth direction is shifted further in the third direction from the target range ARN, thereby increasing likelihood that the position of the attaching portion 32 in the fifth direction is within the target range ARN.

According to the first and second illustrative embodiments, the controller 2 of the cutting apparatus 1 obtains the stiffness of the workpiece 20 (e.g., step S36) and changes the pressure value to another value obtained by subtracting a decrease amount according to the stiffness obtained in step S36 from the current pressure value (e.g., step S39 or S57). Thus, as compared with a case where the decrease amount is specified without consideration of the stiffness of the workpiece 20, in the cutting apparatus 1, the position of the cutting edge of the cutting blade 16 relative to a workpiece may be adjusted appropriately.

According to the first and second illustrative embodiments, as the stiffness obtained in step S36 is higher, the controller 2 of the cutting apparatus 1 assigns a greater value to the decrease amount (e.g., step S39 or S57). Taking the stiffness of the workpiece 20 into consideration may thus reduce likelihood that the position of the attaching portion 32 in the fifth direction is shifted further in the third direction from the target range ARN, thereby increasing likelihood that the position of the attaching portion 32 in the fifth direction is within the target range ARN.

According to the first, second, and third illustrative embodiments, in a case where the position of the attaching portion 32 in the fifth direction obtained in step S52 is shifted in the fourth direction (e.g., upward) from the target range ARN (e.g., YES in step S58), the controller 2 of the cutting apparatus 1 changes the pressure value to another value corresponding to the pressure higher than the current pressure (e.g., step S60). In a case where the position of the attaching portion 32 in the fifth direction is shifted in the fourth direction from the target range ARN, the controller 2 changes the pressure value to another value corresponding to the pressure higher than the current pressure. This may thus reduce likelihood that the position of the attaching portion 32 in the fifth direction is shifted further in the fourth direction from the target range ARN, thereby increasing likelihood that the position of the attaching portion 32 in the fifth direction is within the target range ARN.

According to the first and second illustrative embodiments, the controller 2 of the cutting apparatus 1 obtains the stiffness of the workpiece 20 (e.g., step S36). More specifically, for example, the controller 2 changes the pressure value to another value obtained by adding the increase amount according to the stiffness obtained in step S36 to the current pressure value (e.g., step S39 or S60). Thus, as compared with a case where the increase amount is specified without consideration of the stiffness of the workpiece 20, in the cutting apparatus 1, the position of the cutting edge of the cutting blade 16 relative to a workpiece may be adjusted appropriately.

According to the first and second illustrative embodiments, as the stiffness obtained in step S36 is higher, the controller 2 of the cutting apparatus 1 assigns a greater value to the increase amount (e.g., step S39 or S60). Taking the stiffness of the workpiece 20 into consideration may thus reduce likelihood that the position of the attaching portion 32 in the fifth direction is shifted further in the fourth direction from the target range ARN, thereby increasing likelihood that the position of the attaching portion 32 in the fifth direction is within the target range ARN.

According to the first, second, and third illustrative embodiments, the controller 2 of the cutting apparatus 1 changes the pressure value to another value within the adjustment range PRN specified according to the target range ARN (e.g., steps S56 and S57 or steps S59 and S60). Such a control may thus reduce or prevent the pressure value from being changed to a value out of the adjustment range PRN.

According to the first and second illustrative embodiments, the controller 2 of the cutting apparatus 1 obtains the position of the attaching portion 32 in the fifth direction when the cutting blade 16 held by the attaching portion 32 reaches the upper surface of the holding member 10 holding the workpiece 20 (e.g., step S4). The controller 2 specifies a stop position SP between the position obtained in step S4 and the position of the attaching portion 32 in the fifth direction when the cutting blade 16 held by the attaching portion 32 reaches the upper surface 26 of the platen 3 (e.g., step S35). In a case where the position of the attaching portion 32 in the fifth direction obtained in step S52 is shifted in the third direction from the stop position SP, the controller 2 stops the cutting processing (e.g., step S74). Such a control may thus reduce or prevent the cutting blade 16 held by the attaching portion 32 from reaching the platen 3. In other words, such a control may reduce or prevent the cutting blade 16 from penetrating the holding member 10.

According to the first and second illustrative embodiments, in a case where the controller 2 of the cutting apparatus 1 stops the cutting processing in step S74, the controller 2 restarts to continue the cutting processing stating from the line segment corresponding to a portion of the pattern to be cut next in the cutting order among the line segments constituting the pattern represented by the Mth pattern data piece (e.g., step S80). Such a control may thus reduce likelihood that the cutting processing ends while one or more line segments have not been used for cutting among the ling segments included in the cutting data due to the stop of the cutting processing in step S74. In other words, such a control may thus reduce likelihood that the cutting processing ends while one or more portions of the pattern represented by the Mth pattern data piece remain uncut due to the stop of the cutting processing in step S74.

According to the third illustrative embodiment, the controller 2 specifies a stop position SP shifted in the third direction from the target range AR and shifted in the fourth direction from the position of the attaching portion 32 in the fifth direction when the cutting blade 16 held by the attaching portion 32 reaches the upper surface 26 of the platen 3 (e.g., step S35). In a case where the position of the attaching portion 32 in the fifth direction obtained in step S52 is shifted in the third direction from the stop position SP (e.g., YES in step S54), the controller 2 changes the pressure value to another value obtained by subtracting the first decrease amount from the current pressure value (e.g., step S106). In a case where the position of the attaching portion 32 in the fifth direction obtained in step S52 is shifted in the fourth direction from the stop position SP (e.g., NO in step S54) and is shifted in third direction from the target range AR (e.g., YES in step S55), the controller 2 changes the pressure value to another value by subtracting the second decrease amount from the current pressure value (e.g., step S105). The second decrease amount is smaller than the first decrease amount. Thus, according to the third illustrative embodiment, as compared with a case where a constant value is applied to the attaching portion 32 by the pressure changer 31 during execution of the cutting processing irrespective of the position of the attaching portion 32 in the fifth direction during executing of the cutting processing, in the cutting apparatus 1, the position of the cutting edge of the cutting blade 16 relative to a workpiece may be adjusted appropriately and a likelihood that the cutting blade 16 held by the attaching portion 32 reaches the platen 3 may be reduced.

According to the third illustrative embodiment, in a case where the position of the attaching portion 32 in the fifth direction obtained in step S52 is shifted in the third direction from the stop position SP after the pressure value is changed within the adjustment range PR specified according to the target range AR, the controller 2 of the cutting apparatus 1 shifts the current adjustment range PR by the second decrease amount (e.g., step S107). In the cutting apparatus 1, the adjustment range PR may be thus specified based on the position of the attaching portion 32 in the fifth direction obtained in step S52. In some embodiments, in a case where a workpiece 82 having a releasable sheet 81 to be used for creating, for example, a sticker or a label is cut without using the holding member 10 by one-time execution of the cutting processing, the cutting apparatus 1 may control the height of the attaching portion 32 precisely so that the distal end of the cutting blade 16 is kept located between the upper surface 83 and a lower surface of the releasable sheet 81. The cutting apparatus 1 may preferably be configured to, while controlling the height of the attaching portion 32 so that the distal end of the cutting blade 16 does not reach the platen position PP, avoid stopping the execution of the cutting process in progress or ending the cutting process in progress. According to the third illustrative embodiment, the adjustment range PR may be shifted stepwise. Thus, as compared with a case where a constant adjustment range PR is used, in the cutting apparatus 1, a state where the distal end of the cutting blade 16 sticks in the releasable sheet 81 may be maintained readily while stopping or ending of the cutting process in progress may be avoided or prevented.

According to the first and second illustrative embodiments, in a case where, in the line segments constituting the pattern represented by the Mth pattern data piece, two line segments meeting at a point form a smaller angle having the certain angle or smaller, the controller 2 of the cutting apparatus 1 executes the orientation correction (e.g., step S87). In the orientation correction, the controller 2 changes, at an intersection of the two line segments that form the angle having the certain angle or smaller, a direction in which the cutting blade 16 faces. During execution of the orientation correction, the controller 2 does not change the pressure value in a case where the position of the attaching portion 32 in the fifth direction obtained in step S52 is within the target range ARN (e.g., YES in step S53). In general, while the orientation correction is executed, the position of the attaching portion 32 in the fifth direction is more likely to be unstable than while a line segment is being cut. Nevertheless, according to the cutting apparatus 1, the above control may reduce or prevent the third-direction pressure to be applied to the attaching portion 32 from being changed based on the unstable position of the attaching portion 32 in the fifth direction. In some orientation correction, the height of the attaching portion 32 or the third-direction pressure applied to the attaching portion 32 may be changed during execution of the orientation correction. Nevertheless, according to the cutting apparatus 1, the third-direction pressure applied to the attaching portion 32 is not changed based on the position of the attaching portion 32 in the fifth direction during the orientation correction, thereby reducing or preventing the orientation correction from being executed in an inappropriate manner.

According to the first and second illustrative embodiments, the controller 2 of the cutting apparatus 1 controls the up-down drive mechanism 33 to move the attaching portion 32 in the third direction (e.g., step S29). The controller 2 determines, while controlling the up-down drive mechanism 33, whether the pressure value corresponding to the third-direction pressure applied to the attaching portion 32 by the pressure changer 31 has reached the pressure threshold ThP (e.g., step S91). Then, the controller 2 determines, while controlling the up-down drive mechanism 33, whether the attaching portion 32 has reached the target position in the fifth direction (e.g., step S92). In a case where the controller 2 determines that the attaching portion 32 has reached the target position in the fifth direction (e.g., YES in step S92) before determining, in step S91, that the pressure value has reached the pressure threshold ThP, the controller 2 stops controlling the up-down drive mechanism 33 (e.g., step S93). The controller 2 assigns, to the reference pressure value, the pressure value corresponding to the pressure applied to the attaching portion 32 when the attaching portion 32 is located at the target position in the fifth direction (e.g., step S37). In a case where, before determining, in step S92, that the attaching portion 32 has reached the target position in the fifth direction, the controller 2 determines, in step S91, that the pressure value has reached the threshold ThP (e.g., YES in step S91), the controller 2 stops controlling the up-down drive mechanism 33 (e.g., step S93) and assigns, to the reference pressure value, the pressure value when the attaching portion 32 reaches the position by its movement in the third direction where the pressure value is smaller than or equal to the threshold ThP (e.g., step S37). The controller 2 specifies the target range ARN based on the height of the attaching portion 32 located when stopping controlling the up-down drive mechanism 33 (e.g., step S38). Thus, in the cutting apparatus 1, the target range ARN may be specified based on the position of the attaching portion 32 in the fifth direction when the pressure value is assigned in step S37.

According to the first and second illustrative embodiments, if the controller 2 of the cutting apparatus 1 determines that the pattern represented by the Mth pattern data piece is not a closed figure pattern (e.g., NO in step S22), the controller 2 assigns, to a particular position different from the cutting start point, a setting position on a line segment among the line segments constituting the pattern represented by the Mth pattern data piece (e.g., steps S25 and S26). If the controller 2 determines that the pattern represented by the Mth pattern data piece is not a closed figure pattern (e.g., NO in step S22), the controller 2 moves the attaching portion 32 in the third direction in the specified setting position (e.g., steps S28 and S29). If the controller 2 determines that the pattern represented by the Mth pattern data piece is a closed figure pattern (e.g., YES in step S22), the controller 2 moves the attaching portion 32 in the third direction in the cutting start point (e.g., steps S27, S28, and S29). In general, a depth of a cut to be made may be unstable in the vicinity of the cutting start point. Nevertheless, according to the cutting apparatus 1, in a case where the cutting processing is executed two or more times based on the Mth pattern data piece, a pressure value to be used when a pattern is cut in the workpiece 20 may be specified appropriately according to the shape of the figure represented by the Mth pattern data piece.

According to the first and second illustrative embodiments, the controller 2 assigns, to a particular position, a setting position on a line segment including a cutting start point among the line segments constituting the pattern represented by the Mth pattern data piece (e.g., steps S25 and S26). Thus, in the cutting apparatus 1, a distance that the attaching portion 32 moves from the setting position to the cutting start point may be relatively short. Consequently, a time elapsed from when the pressure value is specified at the setting position to when cutting processing starts may be shortened, thereby completing the cutting processing in a relatively short time. The controller 2 assigns a setting position to a particular position away from the cutting start position by a distance according to the line segment including the cutting start point among the line segments constituting the pattern represented by the Mth pattern data piece (e.g., steps S25 and S26). If a setting position is specified in a random position, a condition for setting the pressure value needs to be changed every time. Nevertheless, in the cutting apparatus 1, the controller 2 may specify the pressure value with respect to each pattern under the same condition.

According to the first and second illustrative embodiments, the controller 2 of the cutting apparatus 1 obtains the position of the attaching portion 32 in the fifth direction when the cutting blade 16 held by the attaching portion 32 reaches the upper surface 18 of the holding member 10 holding the workpiece 20 (e.g., step S4). The controller 2 obtains the number of times of cutting based on the cutting data obtained in step S1 (e.g., step S31). The controller 2 determines whether the position of the attaching portion 32 in the fifth direction obtained in step S62 is shifted in the third direction from the reference position RP obtained in step S32 (e.g., step S64). If the controller 2 determines that the position of the attaching portion 32 in the fifth direction is shifted in the third direction from the reference position RP (e.g., YES in step S64), the controller 2 ends the cutting processing based on the cutting data (e.g., steps S65 and S68) even when the controller 2 determines that the cutting processing has not been executed the number of times of cutting obtained in step S31 (e.g., NO in step S67). That is, if the controller 2 determines, when completing the cutting processing based on the cutting data, that the position of the attaching portion 32 in the fifth direction is shifted in the third direction from the reference position RP (e.g., YES in step S64), the controller 2 ends the cutting processing based on the cutting data (e.g., steps S65 and S68). If the controller 2 determines that the position of the attaching portion 32 in the fifth direction is not shifted in the third direction from the reference position RP (e.g., NO in step S64), the controller 2 executes the cutting processing again (e.g., step S70). Thus, based on the height of the attaching portion 32 when ending the cutting processing at the cutting end point of the cutting data, the controller 2 may determine whether the cutting processing is to be executed another time. Consequently, such a control may reduce or prevent excessive cutting of the holding member 10 caused by execution of unnecessary additional cutting processing although the workpiece 20 has been cut fully in the fifth direction by the previous cutting processing.

According to the first and second illustrative embodiments, the controller 2 of the cutting apparatus 1 determines whether the position of the attaching portion 32 in the fifth direction obtained in step S52 is shifted in the third direction from the reference position RP at the cutting end point in the cutting processing every time the cutting processing is executed until the number of times of cutting obtained in step S31 is achieved (e.g., steps S62 and S64). Such a control may thus end the cutting processing in a case where the position of the attaching portion 32 in the fifth direction obtained in step S52 is shifted in the third direction from the reference position RP at the cutting end point.

According to the first and second illustrative embodiments, in a case where the pattern represented by the Mth pattern data piece is a closed figure pattern, the cutting end point is assigned to a particular position on the line segment that has been cut in the same cutting processing. Thus, as compared with a case where the cutting end point coincides with the cutting start point, the controller 2 of the cutting apparatus 1 may obtain the position of the attaching portion 32 in the fifth direction with stable accuracy. In addition, as compared with a case where the cutting end point coincides with the cutting start point, the controller 2 of the cutting apparatus 1 may appropriately determine whether to end the cutting processing being executed based on the cutting data.

According to the first and second illustrative embodiments, the controller 2 assigns, to a reference position RP, a particular position shifted in the third direction from the holding position HP obtained in step S4 and shifted in the fourth direction from the position of the upper surface 26 of the platen 3. Thus, in a case where the cutting apparatus 1 cuts a workpiece 20 so that the cutting blade 16 penetrates the workpiece 20, such a control may end the cutting processing. In a case where the cutting apparatus 1 cuts the workpiece 20 so that the cutting blade 16 does not penetrates the workpiece 20, such a control may reduce a likelihood to end the cutting processing.

According to the first and second illustrative embodiments, the controller 2 of the cutting apparatus 1 obtains the number of times of cutting to be executed based on the cutting data obtained in step S1 (e.g., step S31). The controller 2 obtains the position of the attaching portion 32 in the fifth direction under a certain condition every time the cutting processing is executed (e.g., step S94). The controller 2 determines, based on a comparison between the preceding position (e.g., the preceding comparison height) and the current position (e.g., the current comparison height) of the attaching portion 32 in the fifth direction, whether the cutting processing is to be discontinued (e.g., step S95 and S96). The preceding position of the attaching portion 32 is obtained in the preceding cutting processing. The current position of the attaching portion 32 is obtained in the current cutting processing. In a case where the controller 2 determines, based on the determination results of steps S95 and S96, that the cutting processing is to be discontinued, the controller 2 discontinues the cutting processing (e.g., step S98). Thus, in a case where the cutting apparatus 1 cuts a pattern in the workpiece 20 by repeating the cutting processing based on the same cutting data, the controller 2 may discontinue the cutting processing based on the result of comparison between the preceding position and the current position. Consequently, in the cutting apparatus 1, such a control may reduce or prevent repeating of the cutting processing in a state where the cutting processing is not executed appropriately.

In the first illustrative embodiment, the certain condition may be that the position of the attaching portion 32 in the fifth direction is obtained when the controller 2 stops moving the attaching portion 32 in the third direction (e.g. S94). In a case where the current position is shifted in the fourth direction from the preceding position or in a case where a difference between the preceding position and the current position is greater than the threshold, the controller 2 determines that the cutting processing is be discontinued (e.g., steps S95 and S96). In ordinary cases, the cutting depth is increased in the third direction from the position (e.g., the depth) of the cut made in the preceding cutting processing, and thus, the current position should be shifted in the third direction from the preceding position. Therefore, in a case where the current position is shifted in the fourth direction from the preceding position, some abnormality may have occurred. According to the cutting apparatus 1, the controller 2 may determine, based on the position of the attaching portion 32 in the fifth direction when the controller 2 specifies the pressure value, whether the cutting processing is to be discontinued. Consequently, the cutting apparatus 1 may discontinue the cutting processing in a case where there is a possibility that some positional abnormality of the attaching portion 32 has occurred in the fifth direction when the Nth cutting processing based on the cutting data obtained in step S1 ends.

In the second illustrative embodiment, the certain condition may be that the position of the attaching portion 32 in the fifth direction is obtained at another certain timing (e.g., step S122). The certain timing may be the time at which, while the attaching portion 32 is moved in the third direction, the pressure value corresponding to the pressure applied to the attaching portion 32 achieves the pressure value that achieved when the attaching portion 32 is stopped in the preceding processing. In a case where the current position is shifted in the fourth direction from the preceding position or in a case where a difference between the preceding position and the current position is greater than the threshold, the controller 2 determines that the cutting processing is be discontinued (e.g., steps S95 and S96). Consequently, in the cutting apparatus 1, the controller 2 may determine whether the cutting processing is to be discontinued, based on the result of comparison between the preceding position of the attaching portion in the fifth direction and the current position of the attaching portion 32 in the fifth direction when the pressure changer 31 applies, to the attaching portion, the pressure corresponding to the pressure value that is the same as that used in the preceding cutting processing. Consequently, the cutting apparatus 1 may discontinue the cutting processing in a case where there is a possibility that some positional abnormality of the attaching portion 32 has occurred in the fifth direction.

While the disclosure has been described in detail with reference to the specific embodiments thereof, these are merely examples, and various changes, arrangements and modifications may be applied therein without departing from the spirit and scope of the disclosure. The cutting apparatus 1 may have another suitable configuration. The cutting apparatus 1 may be configured to execute another processing such as drawing illustrations in addition to the cutting processing using the cutting blade 16. As long as the cutting apparatus 1 moves the attaching portion 32 and the holding member 10 relative to each other in the first and second directions, the cutting apparatus 1 may be configured to, while fixing the position of the holding member 10, move the attaching portion 32 in the first and second directions relative to the holding member 10. The definitions of the first direction, the second direction, the third direction, the fourth direction, and the fifth directions may be changed appropriately. The holding member 10 may be another suitable member other than a mat as long as the holding member 10 can hold a workpiece 20. The holding member 10 may be, for example, a tray. The sensor 41 may be disposed at another suitable position or may have another suitable configuration as long as the sensor 41 is configured to detect the position of the attaching portion 32 in the fifth direction. The sensor 41 may be, for example, an encoder that detects a travel amount of a slit provided in the attaching portion 32 or a sensor that detects the strength and direction of a magnetic field generated by a magnet disposed at the attaching portion 32. Another suitable output of the sensor 41 may be used for determining the position of the attaching portion 32 in the fifth direction. The pressure changer may be an urging member other than a torsion spring as long as the pressure changer is configured to change magnitude of pressure acting toward the platen applied to the attaching portion 32. The pressure changer may be, for example, an air cylinder configured to apply a third-direction pressure to the attaching portion 32.

The main processing of FIG. 6 may be executed by a processor such as a microcomputer, an application specific integrated circuit ("ASIC"), and a field programmable gate array ("FPGA") instead of the controller 2. The cutting processing disclosed in the illustrative embodiments may be executed by a plurality of processors. The flash memory 74 storing the program for executing the cutting processing may be, for example, another non-transitory computer-readable storage medium such as an HDD, SDD, or a hybrid of HDD and SSD. Any non-transitory computer-readable storage medium may be adopted as long as storing information irrespective of a period for storing information. A non-transitory computer-readable storage medium might not necessarily include a transitory computer-readable storage medium (e.g., a signal). The program for executing the main processing may be downloaded from a server connected to a network (i.e., transmitted to the cutting apparatus 1 as signals) and stored in the flash memory 74 of the cutting apparatus 1. In such a case, the program may be stored in a non-transitory computer-readable storage medium such as an HDD of the server. In the main processing according to the illustrative embodiments, the controller 2 might not necessarily execute the steps in the above-described order and may skip one or more of the steps. The main processing may include one or more other steps. The scope of the disclosure includes a case where, for example, an operating system ("OS") running on the cutting apparatus 1 executes part or all of actual processing based on an instruction provided by the controller 2 of the cutting apparatus 1 and the functions of the above-described illustrative embodiments are realized.

Another suitable position may be assigned to the certain position at which the attaching portion 32 is positioned in step S2. The certain position may preferably be defined in an area in which a workpiece 20 is not placed, and more specifically, for example, in an area other than the cutting area defined inside of the border 11 of the holding member 10. In a case where the cutting apparatus 1 can determine a location where a workpiece 20 is placed on the holding member 10, the cutting apparatus 1 may determine the certain position used in step S2 based on the location of the workpiece 20. In such a case, the certain position used in step S2 may be defined within the cutting area. The processing of obtaining the cutting position may be executed in a period from step S3 and step S7 but not overlapping the adjustment of the facing direction of the cutting blade 16. The routine may skip step S6 when necessary.

Another suitable value may be assigned to the pressure value. In a case where a pressure sensor is provided at the attaching portion 32 or the cutting blade 16, a pressure sensor value may be assigned to the pressure value. The pressure value may be changed by another suitable method. In one example, a constant value may be assigned to at least one of the decrease amounts and the increase amount for the pressure value regardless of the stiffness of a workpiece. In another example, a different value may be assigned to at least one of the decrease amounts and the increase amount for the pressure value depending on one or more of the number of times of cutting to be executed, the reference pressure value, the thickness of the workpiece, the type of the workpiece, or the type of the cutting blade 16. The routine may skip either of a series of steps S55, S56, and S57 or a series of steps S58 and S59 in FIG. 9A. The routine may skip either of a series of steps S55, S56, and S105 or a series of steps S58 and S59 in FIG. 13B. The adjustment range PRN might not necessarily be specified. The pressure value may be changed to another value out of the adjustment range PRN. The pressure value may be changed to another pressure value based on the position of the attaching portion 32 during the orientation correction. The controller 2 may adopt a different procedure for specifying the reference position, the target position, and the stop position, according to the type, material, or thickness of the holding member. For example, the stop position might not necessarily be changed depending on the type of the holding member. That is, the stop position may be a constant position. The reference position may be the same as the holding position. The controller 2 may adopt another suitable processing for specifying the holding position or may skip such processing. In the third illustrative embodiment, the first decrease amount, the second decrease amount, and the increase amount may be specified according to the stiffness of the workpiece. In the moving processing of FIGS. 8 and 12, the controller may skip step S91 and stop the attaching portion from moving in the third direction based on the determination made in step S92 (e.g., step S93).

If the controller determines, in step S54 of FIG. 9A, that the attaching portion is shifted in the third direction from the stop position, the controller may execute another suitable processing in the subsequent step. For example, the controller determines, in step S54 of FIG. 9A, that the attaching portion is shifted in the third direction from the stop position, the controller may end the cutting processing. In such a case, in one example, the controller might not necessarily restart to continue the cutting processing. In another example, the controller may restart to continue the cutting processing stating from the constituent point specified by the user based on an instruction to restart the cutting processing input by the user. The routine may skip steps S54, S74 to S80 appropriately. In a case where the controller stops the cutting processing, the controller may assign the value "ON" to the cutting completion setting regardless of the number of times the cutting processing has been stopped. The controller may skip the processing for changing the value of the cutting completion setting. In such a case, the controller may skip a series of steps S65, S68 to S73 and step S83 appropriately.

In the third illustrative embodiment, the second decrease amount may be greater than or equal to the first decrease amount. The routine may skip step S107. In the third illustrative embodiment, in a case the position of the attaching portion in the fifth direction obtained in step S52 is lower than (e.g., shifted in the third direction from) the stop position SP, the controller may stop the cutting processing. The controller may adopt another suitable processing for specifying the pressure value. For example, the controller may determine, while controlling the second moving mechanism, whether the attaching portion has reached the target position without determining whether the pressure value corresponding to the third-direction pressure applied to the attaching portion by the pressure changer has reached the pressure threshold.

In the third illustrative embodiment, the controller may adopt another suitable processing for changing the adjustment range or skip the processing for changing the adjustment range. The controller may specify an upper limit and a lower limit within which the adjustment range is allowed to be shifted and shift the adjustment range between the specified upper and lower limits. In a case where the adjustment range cannot be shifted between the specified upper and lower limits, the controller may stop or discontinue the cutting processing. In a case where, after the adjustment range is shifted (e.g., step S107), the position of the attaching portion in the fifth direction is included within a certain range in a certain time period, the controller may shift the adjustment range to be closer to the adjustment range used when the cutting processing starts (e.g., a default range). The certain range is defined further from the stop position SP in the third direction. Examples of the certain time period include a cutting time (e.g., 50 ms), a period in which the predetermined number of constituent points are cut (e.g., 10 times), and a period in which the predetermined number of orientation corrections are performed (e.g., 5 times). Examples of the certain range includes a range from the stop position SP to the position CP that may be the lower limit of the target range AR. In such a case, for example, in a case where, in the pressure specification and cutting control processing of FIGS. 13A and 13B, the position of the attaching portion in the fifth direction obtained in step S52 is shifted in the fourth direction from the stop position SP (e.g., NO in step S54) and is shifted in third direction from the position CP that is the lower limit of the target range AR (e.g., YES in step S55), the controller may execute the following processing between steps S55 and S56. The controller may count up a variable (e.g., a cutting time) according to the certain time period. In a case where an initial value of the variable is 0 (zero) and the position of the attaching portion in the fifth direction obtained in step S52 is shifted in the third direction from the stop position SP (e.g., YES in step S54) or is shifted in the fourth direction from the position CP that is the lower limit of the target range (e.g., NO in step S55), the controller may assign 0 (zero) to the variable. After stating count-up of the variable according to the certain time period, in a case where the controller has shifted the adjustment range in step S107 and determines, based on the value of the variable, that the certain time period has elapsed, the controller may shift the adjustment range to be closer to the default range within an allowable range. More specifically, for example, the controller 2 may shift the current adjustment range PR in the fourth direction by the second decrease amount. In such a case, the controller of the cutting apparatus may shift the adjustment range to be closer to the default range according to the position of the attaching portion located in the fifth direction after shifting the adjustment range (e.g., step S107).

In the pressure specification processing of FIG. 7, in one example, the controller might not necessarily specify the setting position according to the pattern represented by the Mth pattern data piece. In another example, the controller may specify the setting position using another suitable procedure different from the procedure of FIG. 7. Regardless of whether the pattern represented by the Mth pattern data piece is a closed figure pattern, the controller may specify the setting position using the same procedure. The controller may specify the setting position at any position on the line segment including a cutting start point or at a particular position away from the cutting start point on the line segment. The controller may set the setting position under the same rule regardless of a length of the line segment including the cutting start point or may set the setting position on a line segment including a point other than the cutting start point.

The controller may skip the processing for obtaining the number of times of cutting to be executed. The controller may skip step S64 in which the controller determines whether the attaching portion is shifted in the third direction from the reference position in the fifth direction every time the cutting processing of the Nth time is completed. In such a case, in response to the number of times of the cutting processing that has been executed reaching the number of times of cutting obtained in step S31 (e.g., step S67), the controller may end the cutting processing on the cutting data obtained in step S1. In a case where the cutting data obtained in step S1 includes a plurality of pattern data pieces, one-time execution of the cutting processing may be applied on a basis of pattern data piece. The controller might not necessarily execute the cutting edge adjustment every time one-time execution of the cutting processing is completed. The controller may determine, in each of the cutting processing, whether the attaching portion is shifted in the third direction from the reference position at any one or more points, and may end the cutting processing based on the determination result. The cutting end point may coincide with the cutting start point.

Any suitable condition may be adopted as the certain condition for obtaining the comparison positions in step S94 of FIG. 8 and in step S122 of FIG. 12. The controller may skip the processing for obtaining the comparison positions. The routine may skip a series of steps S94 to S98 in FIGS. 8 and 12. The controller may determine, based on the result of the comparison between the preceding position and the current position using another comparison procedure, whether the cutting processing is to be discontinued.

What is claimed is:

1. A cutting apparatus comprising:

a platen;

an attaching portion configured to hold a cutting blade;

a first moving mechanism configured to move a workpiece supported by the platen and the attaching portion relative to each other in a first direction and a second direction, the second direction intersecting the first direction, the first moving mechanism including an X-axis motor and a Y-axis motor for moving the workpiece and the attaching portion relative to each other in the first direction and the second direction;

a second moving mechanism configured to move the attaching portion in a third direction and a fourth direction, the third direction intersecting the first and second directions and being a direction in which the second moving mechanism moves the attaching portion toward the platen, and the fourth direction intersecting the first and second directions and being a direction in which the second moving mechanism moves the attaching portion away from the platen, the second moving mechanism includes a Z-axis motor for moving the attaching portion in the third direction;

a pressure changer configured to, in response to movement of the attaching portion caused by the second moving mechanism, change magnitude of pressure to be applied to the attaching portion in the third direction; and a controller configured to control the first moving mechanism and the second moving mechanism, the controller configured to execute:

data obtainment including obtaining cutting data representing a pattern to be cut in the workpiece;

pressure specification including specifying a pressure value corresponding to the pressure to be applied to the attaching portion by the pressure changer during execution of cutting processing for cutting the workpiece based on the obtained cutting data;

target range specification including specifying a target range defining a range of target positions of the attaching portion in a fifth direction during execution of the cutting processing, the fifth direction including the third direction and the fourth direction;

cutting control including controlling the first moving mechanism while controlling the second moving mechanism, thereby executing cutting processing for cutting the workpiece using the cutting blade held by the attaching portion, controlling the first moving mechanism including moving the workpiece supported by the platen and the attaching portion relative to each other in the first direction and the second direction, and controlling the second moving mechanism including causing the pressure changer to apply, to the attaching portion, the pressure corresponding to the pressure value specified in the pressure specification;

position obtainment including obtaining the position of the attaching portion in the fifth direction during execution of the cutting processing in the cutting control;

position determination including determining whether the position of the attaching portion in the fifth direction obtained in the position obtainment is out of the target range; and pressure change in a case where the position determination determines that the position of the attaching portion in the fifth direction obtained in the position obtainment is out the target range, the pressure change including changing the pressure value specified in the pressure specification to a particular pressure value different from a current pressure value, wherein the controller is configured to, in a case where the pressure value specified in the pressure specification is changed to the particular pressure value in the pressure change, execute the cutting control while causing the pressure changer to apply, to the attaching portion, the pressure corresponding to the particular pressure value.

2. The cutting apparatus according to claim 1, wherein, in the position determination, it is determined whether the position of the attaching portion in the fifth direction obtained in the position obtainment is shifted in the third direction from a lower limit of the target range, and in the pressure change, in a case where the position of the attaching portion in the fifth direction obtained in the position obtainment is shifted in the third direction from a lower limit of the target range, changing a specified pressure value to the particular pressure value includes changing the specified pressure value to a value corresponding to pressure lower than the pressure currently applied to the attaching portion.

3. The cutting apparatus according to claim 2, wherein the controller is further configured to execute a stiffness obtainment including obtaining a stiffness of the workpiece, and wherein the value corresponding to pressure lower than the pressure currently applied to the attaching portion is obtained by subtracting, from the current pressure value, a decrease value according to the stiffness obtained in the stiffness obtainment.

4. The cutting apparatus according to claim 3, wherein, in the pressure change, changing the pressure value specified in the pressure specification to the particular pressure value includes assigning a greater value to the decrease amount as the stiffness obtained in the stiffness obtainment is higher.

5. The cutting apparatus according to claim 1, wherein, in the position determination, it is determined whether the position of the attaching portion in the fifth direction obtained in the position obtainment is shifted in the fourth direction from an upper limit of the target range, and wherein, in the pressure change, in a case where the position of the attaching portion in the fifth direction obtained in the position obtainment is shifted in the fourth direction from an upper limit of the target range, changing the specified pressure value to the particular pressure value includes changing a specified pressure value to a value corresponding to pressure higher than pressure currently applied to the attaching portion.

6. The cutting apparatus according to claim 5, wherein the controller is further configured to execute a stiffness obtainment including obtaining a stiffness of the workpiece, and wherein the value corresponding to pressure higher than the pressure currently applied to the attaching portion is obtained by adding, to the current pressure value, an increase value according to the stiffness obtained in the stiffness obtainment.

7. The cutting apparatus according to claim 6, wherein, in the pressure change, changing the pressure value specified in the pressure specification to the particular pressure value includes assigning a greater value to the increase amount as the stiffness obtained in the stiffness obtainment is higher.

8. The cutting apparatus according to claim 1, wherein, in the pressure change, changing a specified pressure value to the particular pressure value includes changing the specified pressure value to another value within an adjustment range specified according to the target range.

9. The cutting apparatus according to claim 1, wherein the workpiece is held by a holding member, wherein the controller is further configured to execute:

holding position obtainment including obtaining the position of the attaching portion in the fifth direction when a distal end of the cutting blade reaches a first surface of the holding member holding the workpiece, the first surface of the holding member holding the workpiece;

stop position specification including specifying a stop position between the position of the attaching portion in the fifth direction obtained in the holding position obtainment and the position of the attaching portion in the fifth direction when the distal end of the cutting blade held by the attaching portion reaches a second surface of the platen, the second surface holding the holding member; and stop control in a case where the position of the attaching portion in the fifth direction obtained in the position obtainment is shifted in the third direction from the stop position, the stop control including stopping the cutting processing executed in the cutting control.

10. The cutting apparatus according to claim 9, wherein the pattern represented by the cutting data includes line segments and wherein the controller is further configured to, in a case where the controller stops the cutting processing in the stop control, execute restart control, the restart control including restarting to continue the cutting processing starting from a line segment corresponding to a portion of the pattern to be cut next in a cutting order among the line segments represented by the cutting data.

11. The cutting apparatus according to claim 1, wherein the controller is further configured to execute stop position specification including specifying a stop position to be shifted in the third direction from a lower limit of the target range and shifted in the fourth direction from the position of the attaching portion in the fifth direction when a distal end of the cutting blade held by the attaching portion reaches the second surface of the platen, wherein, in the pressure change, changing the pressure value specified in the pressure specification to the particular pressure value includes:

in a case where the position of the attaching portion in the fifth direction obtained in the position obtainment is shifted in the third direction from the stop position, changing a specified pressure value to a value obtained by subtracting, from the current pressure value, a first decrease value; and in a case where the position of the attaching portion in the fifth direction obtained in the position obtainment is shifted in the fourth direction from the stop position and in the third direction from the lower limit of target range, changing the specified pressure value to a value obtained by subtracting, from the current pressure value, a second decrease value that is smaller than the first decrease value.

12. The cutting apparatus according to claim 11, wherein, in the pressure change, changing the pressure value specified in the pressure specification to the particular pressure value includes:

changing the specified pressure value to another value within an adjustment range specified according to the target range; and in a case where the position of the attaching portion in the fifth direction obtained in the position obtainment is shifted in the third direction from the stop position, shifting the adjustment range by the second decrease amount.

13. The cutting apparatus according to claim 1, wherein the pattern represented by the cutting data includes line segments and two of the line segments meeting at a point form smaller and larger angles, respectively, on opposite sides thereof, wherein the cutting control further includes, in a case where an angle measure of the smaller angle is equal to or smaller than a certain angle, executing an orientation correction to change a direction in which the cutting blade faces, and wherein the pressure change further includes, during execution of the orientation correction, preventing the change of the pressure value based on whether the position of the attaching portion in the fifth direction obtained in the position obtainment is within the target range.

14. The cutting apparatus according to claim 1, wherein the controller is further configured to execute:

movement control including controlling the second moving mechanism to move the attaching portion in the third direction;

first determination while controlling the second moving mechanism in the movement control, the first determination including determining whether the pressure value has reached a pressure threshold, the pressure value corresponding to the magnitude of the pressure applied to the attaching portion in the third direction by the pressure changer; and second determination while controlling the second moving mechanism in the movement control, the second determination including determining whether the attaching portion has reached a target position in the fifth direction, wherein, in the pressure specification, specifying the pressure value includes:

in a case where, before the controller determines, in the first determination, that the pressure corresponding value has reached the pressure threshold, the controller determines, in the second determination, that the attaching portion has reached the target position in the fifth direction, stopping the movement control and assigning, to the pressure value, a value corresponding to the pressure applied to the attaching portion located at the target position in the fifth direction; and in a case where, before the controller determines, in the second determination, that the attaching portion has reached the target position in the fifth direction, the controller determines, in the first determination, that the pressure value has reached the pressure threshold, stopping the movement control and assigning, to the pressure value, a value achieved when the attaching portion reaches a particular position where the pressure value corresponding to the pressure applied to the attaching portion is smaller than or equal to the pressure threshold by movement of the attaching portion in the third direction, and wherein, in the target range specification, specifying the target range includes specifying the target range based on the position of the attaching portion when the controller stops the movement control in the pressure specification.

15. The cutting apparatus according to claim 14, wherein the pattern represented by the cutting data includes line segments, wherein the controller is further configured to execute setting position specification including, in a case where the pattern represented by the cutting data is not closed, assigning, to a particular position different from a cutting start point, a setting position on one of the line segments represented by the cutting data, and wherein, in the movement control, controlling the second moving mechanism to move the attaching portion in the third direction includes:

in a case where the pattern represented by the cutting data is not closed, moving the attaching portion in the third direction in the setting position; and in a case where the pattern represented by the cutting data is closed, moving the attaching portion in the third direction in the cutting start position.

16. The cutting apparatus according to claim 15, wherein, in the setting position specification, assigning the setting position to the particular position including assigning the setting position to a particular position on a line segment including the cutting start point among the line segments included in the pattern.

17. The cutting apparatus according to claim 16, wherein, in the setting position specification, assigning the setting position to the particular position including assigning the setting position to a particular position away from the cutting start point by a distance according to a length of the line segment including the cutting start point among the line segments included in the pattern.

18. The cutting apparatus according to claim 14, wherein the controller is further configured to execute:

execution number obtainment including obtaining a number of times of cutting processing to be executed based on the cutting data;

comparison position obtainment including obtaining the position of the attaching portion in the fifth direction under a certain condition every time the cutting processing is executed;

discontinuation determination including determining, based on a comparison result between a preceding position and a current position of the attaching portion in the fifth direction, whether the cutting processing is to be discontinued, wherein a last-time position of the attaching portion is obtained in a last-time cutting processing in the comparison position obtainment and a this-time position of the attaching portion is obtained in the current cutting processing in the comparison position obtainment; and discontinuation control in a case where the controller determines, in the discontinuation control, that the cutting processing is to be discontinued, the discontinuation control including discontinuing the cutting processing, wherein the certain condition includes a condition that the position of the attaching portion in the fifth direction is obtained when the controller stops moving the attaching portion in the third direction in the movement control, and wherein, in the discontinuation control, discontinuing the cutting processing includes, in a case where the this-time position is shifted in the fourth direction from the last-time position or in a case where a difference between the last-time position and the this-time position is greater than a threshold.

19. The cutting apparatus according to claim 14, wherein the controller is further configured to execute:

execution number obtainment including obtaining a number of times of cutting processing to be executed based on the cutting data;

comparison position obtainment including obtaining the position of the attaching portion in the fifth direction under a certain condition every time the cutting processing is executed;

discontinuation determination including determining, based on a comparison result between a preceding position and a current position of the attaching portion in the fifth direction, whether the cutting processing is to be discontinued, wherein a last-time position of the attaching portion is obtained in a last-time cutting processing in the comparison position obtainment and a this-time position of the attaching portion is obtained in the current cutting processing in the comparison position obtainment; and discontinuation control in a case where the controller determines, in the discontinuation control, that the cutting processing is to be discontinued, the discontinuation control including discontinuing the cutting processing, wherein the certain condition includes a condition that while the attaching portion is moved in the third direction, the position of the attaching portion in the fifth direction is obtained at a certain timing, and the certain timing is a time at which, while the attaching portion is moved in the third direction, the pressure value corresponding to the pressure applied to the attaching portion achieves the pressure value that achieved when the attaching portion is stopped in the preceding processing, and wherein, in the discontinuation control, discontinuing the cutting processing includes, in a case where the this-time position is shifted in the fourth direction from the last-time position or in a case where a difference between the last-time position and the this-time position is greater than a threshold.

20. The cutting apparatus according to claim 1, wherein the workpiece is held by a holding member, wherein the controller is further configured to execute:

holding position obtainment including obtaining the position of the attaching portion in the fifth direction when a distal end of the cutting blade reaches a first surface of the holding member holding the workpiece, the first surface of the holding member holding the workpiece;

execution number obtainment including obtaining a number of times of cutting processing to be executed based on the cutting data;

third determination including determining whether the position of the attaching portion in the fifth direction obtained in the position obtainment is shifted in the third direction from a reference position specified based on the position of the attaching portion in the fifth direction in the holding position obtainment; and end control in a case where, in the third determination, the position of the attaching portion in the fifth direction is shifted in the third direction from the reference position, the end control including ending the cutting processing based on the cutting data even when the cutting processing has not been executed the number of times of cutting processing obtained in the execution number obtainment.

21. The cutting apparatus according to claim 20, wherein, in the third determination, determining whether the position of the attaching portion in the fifth direction obtained in the position obtainment is shifted in the third direction from the reference position includes determining whether the position of the attaching portion in the fifth direction obtained in the position obtainment is shifted in the third direction from the reference position at a cutting end point in the cutting processing every time the cutting processing is executed.

22. The cutting apparatus according to claim 21, wherein the cutting end point is assigned to a particular position on the line segment that has been cut in the same time cutting processing.

23. The cutting apparatus according to claim 20, wherein the reference position is assigned to a particular position shifted in the third direction from the position of the attaching portion obtained in the holding position obtainment and shifted in the fourth direction from a second surface of the platen, the second surface holding the holding member.

24. The cutting apparatus according to claim 1, wherein the controller is further configured to execute:

execution number obtainment including obtaining a number of times of cutting processing to be executed based on the cutting data;

comparison position obtainment including obtaining the position of the attaching portion in the fifth direction under a certain condition every time the cutting processing is executed;

discontinuation determination including determining, based on a comparison result between a preceding position and a current position of the attaching portion in the fifth direction, whether the cutting processing is to be discontinued, wherein the preceding position of the attaching portion is obtained in the preceding cutting processing in the comparison position obtainment and the current position of the attaching portion is obtained in the current cutting processing in the comparison position obtainment; and discontinuation control in a case where the controller determines, in the discontinuation determination, that the cutting processing is to be discontinued, the discontinuation control including discontinuing the cutting processing.

* * * * *